US010316489B2

(12) United States Patent
Tomita et al.

(10) Patent No.: US 10,316,489 B2
(45) Date of Patent: Jun. 11, 2019

(54) WORK MACHINE AND HYDRAULIC SYSTEM FOR WORK MACHINE

(71) Applicant: KUBOTA CORPORATION, Osaka-shi (JP)

(72) Inventors: Jun Tomita, Sakai (JP); Yuji Fukuda, Sakai (JP); Yuya Konishi, Sakai (JP)

(73) Assignee: KUBOTA CORORATION, Osaka-shi (JP)

( * ) Notice: Subject to any disclaimer, the term of this patent is extended or adjusted under 35 U.S.C. 154(b) by 183 days.

(21) Appl. No.: 15/371,102

(22) Filed: Dec. 6, 2016

(65) Prior Publication Data

US 2017/0159265 A1 Jun. 8, 2017

(30) Foreign Application Priority Data

Dec. 7, 2015 (JP) ..... 2015-238562
Mar. 31, 2016 (JP) ..... 2016-072869
Sep. 27, 2016 (JP) ..... 2016-188000

(51) Int. Cl.
*E02F 3/42* (2006.01)
*F15B 1/02* (2006.01)
(Continued)

(52) U.S. Cl.
CPC ..... *E02F 3/422* (2013.01); *E02F 3/432* (2013.01); *E02F 9/2203* (2013.01); *E02F 9/2217* (2013.01); *E02F 9/2267* (2013.01); *E02F 9/2282* (2013.01); *F15B 1/021* (2013.01); *E02F 3/3414* (2013.01); *F15B 2211/3059* (2013.01); *F15B 2211/30565* (2013.01);
(Continued)

(58) Field of Classification Search
CPC ..... E02F 3/432; E02F 9/2207
USPC ..... 91/515, 520, 531
See application file for complete search history.

(56) References Cited

U.S. PATENT DOCUMENTS 4,561,342 A 12/1985 Calvert
5,797,310 A * 8/1998 Casey ..... E02F 3/433 60/424
(Continued)

FOREIGN PATENT DOCUMENTS

JP 2004-340313 12/2004
JP 2004-360300 12/2004
(Continued)

*Primary Examiner* — Michael Leslie
*Assistant Examiner* — Matthew Wiblin
(74) *Attorney, Agent, or Firm* — Mori & Ward, LLP

(57) ABSTRACT

A hydraulic system for a work machine includes a first control valve to control a first hydraulic actuator, a second control valve to control a second hydraulic actuator, a first fluid tube connecting the first hydraulic actuator to the first control valve, and a second fluid tube connecting the second hydraulic actuator to the second control valve. A level control valve apparatus is connected to the first fluid tube and the second fluid tube. The level control valve apparatus is configured to control a leveling operation for the second hydraulic actuator. An accumulator apparatus is connected to the first hydraulic actuator. The accumulator apparatus communicates with the first fluid tube between the level control valve apparatus and the first control valve. Circuitry is configured to control the level control valve apparatus to stop the leveling operation when the accumulator apparatus is in operation.

19 Claims, 15 Drawing Sheets

(51) Int. Cl.
*E02F 9/22* (2006.01)
*E02F 3/43* (2006.01)
*E02F 3/34* (2006.01)

(52) U.S. Cl.
CPC ..... *F15B 2211/30595* (2013.01); *F15B 2211/625* (2013.01); *F15B 2211/6658* (2013.01); *F15B 2211/71* (2013.01)

(56) References Cited

U.S. PATENT DOCUMENTS

| | | | | |
|---|---|---|---|---|
| 6,389,953 | B1 * | 5/2002 | Altman | B66F 9/22 414/708 |
| 8,726,786 | B2 * | 5/2014 | Miki | E02F 3/433 91/515 |
| 2007/0006491 | A1 * | 1/2007 | Ioku | E02F 3/432 37/348 |
| 2009/0082930 | A1 * | 3/2009 | Peters | A01B 63/1117 701/50 |
| 2012/0251283 | A1 * | 10/2012 | Violland | B66F 9/22 414/697 |
| 2014/0178164 | A1 * | 6/2014 | Peterson | E02F 3/432 414/685 |
| 2014/0245728 | A1 * | 9/2014 | Kobayashi | E02F 9/2207 60/413 |

FOREIGN PATENT DOCUMENTS

| | | |
|---|---|---|
| JP | 2007-186942 | 7/2007 |
| JP | 2010-084784 | 4/2010 |

* cited by examiner

WORK MACHINE AND HYDRAULIC SYSTEM FOR WORK MACHINE

CROSS-REFERENCE TO RELATED APPLICATIONS

The present application claims priority under 35 U.S.C. § 119 to Japanese Patent Application No. 2015-238562, filed Dec. 7, 2015, to Japanese Patent Application No. 2016-72869, filed Mar. 31, 2016, and to Japanese Patent Application No. 2016-188000, filed Sep. 27, 2016. The contents of these applications are incorporated herein by reference in their entirety.

BACKGROUND OF THE INVENTION

Field of the Invention

The present invention relates to a work machine and to a hydraulic system for the work machine.

Discussion of the Background

A hydraulic system for a work machine described in Japanese Unexamined Patent Publications No. 2004-360300, No. 2007-186942, and No. 2010-84784 are known. The work machine described in Japanese Unexamined Patent Publication No. 2004-360300 includes a boom, a bucket, a boom cylinder configured to move the boom, a bucket cylinder configured to move the bucket, a first control valve configured to control the boom cylinder to be stretched and shortened, and a second control valve configured to control the bucket cylinder to be stretched and shortened. An operation fluid discharged from a pump is supplied to the first control valve and the second control valve.

The hydraulic system described in Japanese Unexamined Patent Publication No. 2007-186942 is a hydraulic system configured to provide a ride control in the work machine. The ride control is a technique to suppress fluctuation of a pressure of the boom cylinder and thus suppress vibrations in traveling of the work machine (provide an anti-vibration operation in a machine body).

The work machine described in Japanese Unexamined Patent Publication No. 2010-84784 includes a boom, a bucket, a boom cylinder configured to move the boom, a bucket cylinder configured to move the bucket, a first control valve configured to control the boom cylinder to be stretched and shortened, and a second control valve configured to control the bucket cylinder to be stretched and shortened. An operation fluid discharged from a pump is supplied to the first control valve and the second control valve.

SUMMARY OF THE INVENTION

According to one aspect of the present invention, a hydraulic system for a work machine includes a first hydraulic actuator, a second hydraulic actuator other than the first hydraulic actuator, a first control valve configured to control the first hydraulic actuator, a second control valve to control the second hydraulic actuator, a first fluid tube connecting the first hydraulic actuator to the first control valve, a second fluid tube connecting the second hydraulic actuator to the second control valve, a level control valve apparatus connected to the first fluid tube and the second fluid tube, the level control part controller being configured to control a leveling operation for the second hydraulic actuator, an accumulator apparatus connected to the first hydraulic actuator, the accumulator apparatus communicating with the first fluid tube between the level control valve apparatus and the first control valve, and circuitry configured to control the level control valve apparatus to stop the leveling operation when the accumulator apparatus is in operation.

According to another aspect of the present invention, a hydraulic system for a work machine includes a first hydraulic actuator, a second hydraulic actuator other than the first hydraulic actuator, a first control valve to control the first hydraulic actuator, a second control valve to control the second hydraulic actuator, a first fluid tube connecting the first hydraulic actuator to the first control valve, a second fluid tube connecting the second hydraulic actuator to the second control valve, a level control valve apparatus connected to the first fluid tube and the second fluid tube, the level control valve apparatus being configured to control a leveling operation for the second hydraulic actuator, an accumulator apparatus connected to the first hydraulic actuator, and a third fluid tube having a first tube end connected to the first hydraulic actuator and a second tube end which is opposite to the first tube and which is connected to the first fluid tube between the level control valve apparatus and the first control valve.

According to further aspect of the present invention, a hydraulic system for a work machine includes a first hydraulic actuator, a second hydraulic actuator other than the first hydraulic actuator, a first control valve to control the first hydraulic actuator, a second control valve to control the second hydraulic actuator, a first fluid tube connecting the first hydraulic actuator to the first control valve, a second fluid tube connecting the second hydraulic actuator to the second control valve, a level control valve apparatus connected to the first fluid tube and the second fluid tube, the level control valve apparatus being configured to control a leveling operation for the second hydraulic actuator, an accumulator apparatus connected to the first hydraulic actuator and configured to provide an anti-vibration operation to suppress fluctuation of a pressure of the first hydraulic actuator, the accumulator apparatus being configured to switch an operational state between a stopping state to stop the anti-vibration operation, a first operational state to activate both of the leveling operation and the anti-vibration operation, and a second operational state to activate the anti-vibration operation.

According to further aspect of the present invention, a hydraulic system for a work machine includes, a first hydraulic actuator having a first fluid chamber and a second fluid chamber; a second hydraulic actuator other than the first hydraulic actuator, a first control valve to control the first hydraulic actuator, a second control valve to control the second hydraulic actuator, a first fluid tube connecting the first hydraulic actuator to the first control valve, a second fluid tube connecting the second hydraulic actuator to the second control valve; a level control valve apparatus connected to the first fluid tube and the second fluid tube, the level control valve apparatus being configured to control a leveling operation for the second hydraulic actuator, an accumulator apparatus connected to the first hydraulic actuator and configured to provide an anti-vibration operation to suppress fluctuation of a pressure of the first hydraulic actuator, and a discharge fluid tube connected to the accumulator apparatus, the discharge fluid tube being configured to discharge an operation fluid supplied from the accumulator apparatus. The accumulator apparatus includes an accumulator and a ride control valve configured to be switched to a stopping position to block a connection between the accumulator and the first fluid chamber of the first hydraulic actuator and to block a connection between the discharge fluid tube and the second fluid chamber of the first hydraulic actuator, a first activating position to connect the first fluid chamber to the accumulator and to block the connection between the second fluid chamber and the discharge fluid tube, and thus to activate both of the leveling operation and the anti-vibration operation, and a second activating position to connect the first fluid chamber to the accumulator and to connect the second fluid chamber to the discharge fluid tube, and thus to activate the anti-vibration operation.

According to further aspect of the present invention, a hydraulic system for a work machine includes a first hydraulic actuator, a second hydraulic actuator other than the first hydraulic actuator, and an accumulator apparatus connected to the first hydraulic actuator and configured to provide an anti-vibration operation to suppress fluctuation of a pressure of the first hydraulic actuator, the accumulator apparatus being configured to be switched to a stopping state to stop the anti-vibration operation, a first activating state to activate both of the second hydraulic actuator and the anti-vibration operation, and a second activating state to activate the anti-vibration operation.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
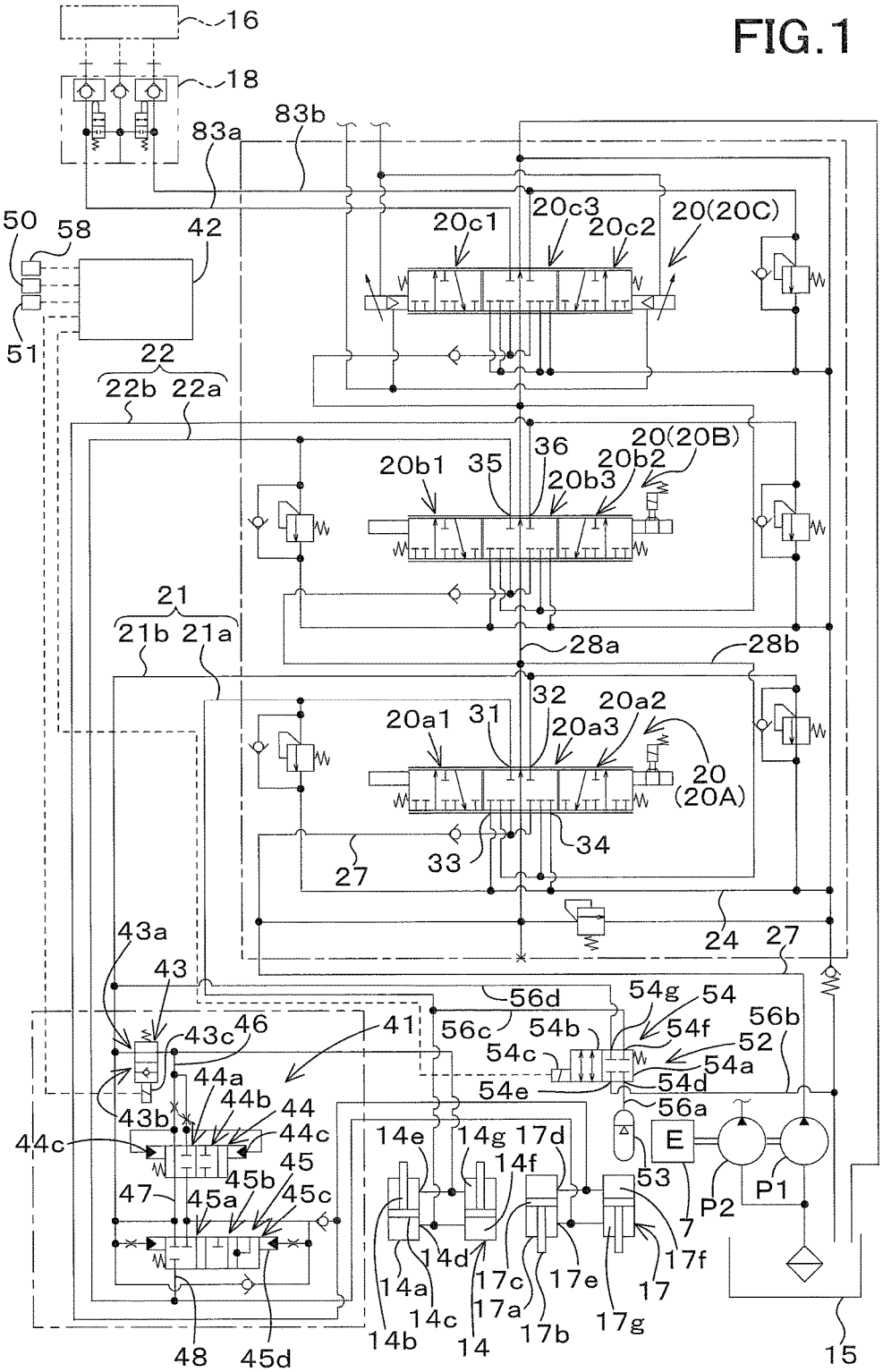
FIG. 1 is a view illustrating a hydraulic system (a hydraulic circuit) according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Referring to drawings, the preferred embodiments of the present invention will explain below a hydraulic system for a work machine and the work machine including the hydraulic system.

(First Embodiment)

The work machine will be explained first.

Figure 10:
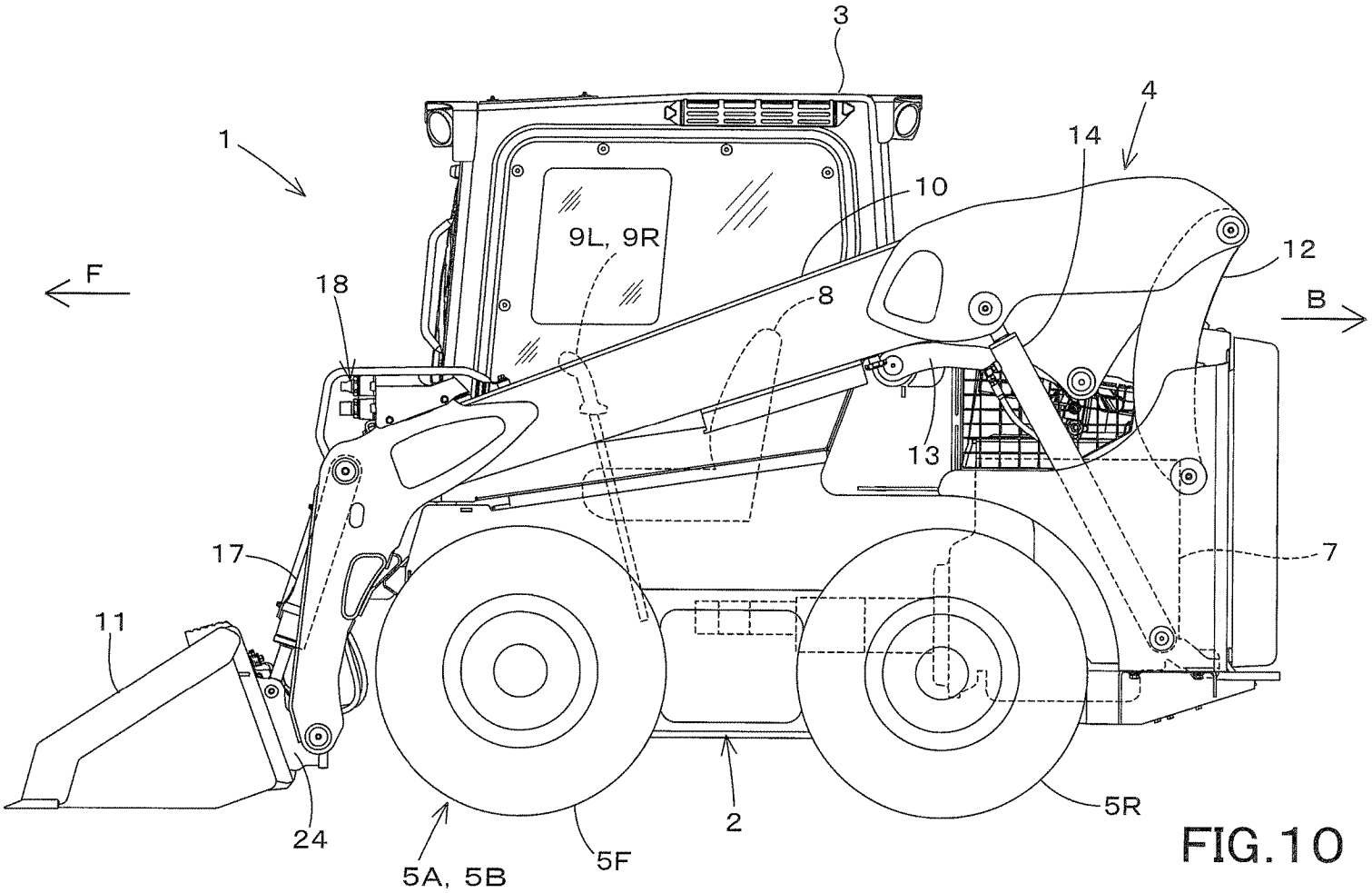
FIG. 10 is a view illustrating an overall of a skid steer loader exemplified as a work machine according to the embodiments of the present invention.

FIG. 10 illustrates a side view of a work machine 1 according to a first embodiment of the present invention. FIG. 10 illustrates a skid steer loader as an example of the work machine 1. The work machine 1 according to the embodiment however is not limited to the skid steer loader, and accordingly may be other types of loader work machines such as a Compact Track Loader (CTL). The work machine 1 also may be a work machine other than the loader work machine.

The work machine 1 includes a machine body (vehicle body) 2, a cabin 3, a operation device 4, a travel device 5A, and a travel device 5B.

A cabin 3 is mounted on the machine body 2. An operator seat 8 is disposed on a rear portion inside the cabin 5. In explanations of the embodiment of the present invention, a forward direction (a direction shown by an arrowed line F in FIG. 10) corresponds to a front side of an operator seating on the operator seat 8 of the work machine 1, a backward direction (a direction shown by an arrowed line B in FIG. 10) corresponds to a back side of the operator, a leftward direction (a direction vertically extending from a back surface to a front surface of FIG. 10) corresponds to a left side of the operator, and a rightward direction (a direction vertically extending from the front surface to the back surface of FIG. 10) corresponds to a right side of the operator. In addition, a machine width direction corresponds to a horizontal direction that is a direction perpendicular to a front-back direction. A direction extending from a central portion of the machine body 2 toward the right portion is referred to as a machine outward direction. A direction extending from the central portion of the machine body 2 toward the left portion is also referred to as the machine outward direction.

In other words, the machine outward direction is a direction corresponding to the machine width direction and separating from the machine body 2. The explanation will be made describing a direction opposite to the machine outward direction as a machine inward direction. In other words, the machine inward direction is a direction corresponding to the machine width direction and approaching to the machine body 2.

The cabin 3 is mounted on the machine body 2. The operation device 4 is a device configured to provide operations, and is disposed on the machine body 2. The travel device 5A is a device configured to make the machine body 2 travel, and is disposed on a left side portion of the machine frame 2. The travel device 5B is a device configured to make the machine body 2 travel, and is disposed on a right side portion of the machine frame 2.

An motor 7 is disposed on a rear portion inside the machine frame 2. The motor 7 is a diesel engine (an engine). The motor 7 however is not limited to the engine, and may be an electric motor and the like.

A travel lever 9L is disposed left to the operator seat 8. A travel lever 9R is disposed right to the operator seat 8. The travel lever 9L disposed on the left is used for operating the travel device 5A disposed on the left, and the travel lever 9R disposed on the right is used for operating the travel device 5B disposed on the right.

The operation device 4 includes a boom 10, a bucket 11, a lift link 12, a control link 13, a boom cylinder 14, and a bucket cylinder 17. The boom 10 is disposed lateral to the machine body 2. The bucket 11 is disposed on a tip end (a front end) of the boom 10. The lift link 12 and the control link 13 support a base portion (a rear portion) of the boom 10. The boom cylinder 14 moves the boom 10 upward and downward.

In particular, the lift link 12, the control link 13, and the boom cylinder 14 are disposed lateral to the machine body 2. An upper portion of the lift link 12 is pivotally supported by an upper portion of the base portion of the boom 10. A lower portion of the lift link 12 is pivotally supported by a side portion of the rear portion of the machine body 2. The control link 13 is arranged in front of the lift link 12. One end of the control link 13 is pivotally supported by a lower portion of the base portion of the boom 10. The other end of the control link 13 is pivotally supported by the machine body 2.

The boom cylinder 14 is a hydraulic cylinder configured to move the boom 10 upward and downward. An upper portion of the boom cylinder 14 is pivotally supported by a front portion of the base portion of the boom 10. A lower portion of the boom cylinder 14 is pivotally supported by a side portion of the rear portion of the machine body 2. The lift link 12 and the control link 13 move the boom 10 upward and downward when the boom cylinder 14 is stretched and shortened.

The bucket cylinder 17 is a hydraulic cylinder configured to swing the bucket 11. The bucket cylinder 17 connects a left portion of the bucket 11 to the boom 10 disposed on the left, and connects a right portion of the bucket 11 to the boom 10 disposed on the right. Not only the bucket 11, other work tools can be attached to the tip end (the front portion) of the boom 10. The following attachments (spare attachments) are exemplified as the other work tools; for example, a hydraulic crusher, a hydraulic breaker, an angle broom, an earth auger, a pallet fork, a sweeper, a mower, a snow blower, and the like.

In the embodiment, each of the travel devices 5A and 5B employs a wheeled travel device, the wheeled travel device having a front wheel 5F and a rear wheel 5R. However, a crawler travel device (including a semi-crawler travel device) may be employed as each of the travel devices 5A and 5B.

The steer skid loader 1 includes a hydraulic circuit for an operational system, that is, an operational hydraulic circuit (a hydraulic system for a work machine). The hydraulic circuit will be explained below.

The operational hydraulic system is a system configured to operate the boom 10, the bucket 11, an auxiliary attachment, and the like. As shown in FIG. 1, the operational hydraulic system includes a plurality of control valves 20 and a hydraulic pump (a first hydraulic pump) P1 for operations. In addition, the operational hydraulic system includes a second hydraulic pump P2 other than the first hydraulic pump P1. The operational hydraulic system further includes a tank (an operation fluid tank) 15 configured to store an operation fluid (an operation oil).

The first hydraulic pump P1 is a pump to be driven by a motive power of the motor 7, and is constituted of a gear pump of a constant displacement type, for example. The first hydraulic pump P1 is capable of discharging the operation fluid stored in the tank (the operation fluid tank) 15. The second hydraulic pump P2 is a pump to be driven by the motive power of the motor 7, and is constituted of a gear pump of a constant displacement type, for example.

The second hydraulic pump P2 is capable of discharging the operation fluid stored in the tank (the operation fluid tank) 15. The second hydraulic pump P2 meanwhile discharges an operation fluid for control and an operation fluid for signal in the hydraulic system. Each of the operation fluid for signal and the operation fluid for control is referred to as a pilot fluid (a pilot oil).

The plurality of control valves 20 are valves to control various types of hydraulic actuators disposed on the work machine 1. The hydraulic actuators are devices configured to be operated (activated) by the operation fluid, and are hydraulic cylinders, hydraulic motors, and the like. In the embodiment, the plurality of control valves 20 includes a first control valve 20A, a second control valve 20B, and the third control valve 20C.

The first control valve 20A is a valve to control the boom cylinder (the hydraulic actuator) 14, the boom cylinder 14 being configured to move the boom 10.

The first control valve 20A is a three-position switch valve of a direct-acting spool type. The first control valve 20A is capable of being switched to a neutral position 20*a*3, a first position 20*a*1 other than the neutral position 20*a*3, and a second position 20*a*2 other than the neutral position 20*a*3 and the first position 20*a*1. The first control valve 20A is switched to the neutral position 20*a*3, the first position 20*a*1, and the second position 20*a*2 by a spool, the spool being operated by an operation member.

The spool meanwhile is moved directly by manually operating the operation member, and thus the movement of the spool switches the first control valve 20A. The spool however may be moved by a hydraulic operation (a hydraulic operation by a pilot valve and a hydraulic operation by a proportional valve), may be moved by an electric operation (an electric operation by magnetization of a solenoid), and may be moved by other methods. For convenience of description, the hydraulic actuator (the boom cylinder) 14 may be referred to as the first hydraulic actuator 14.

The first control valve 20A is connected to the first hydraulic pump P1 by a discharge fluid tube (discharge fluid path) 27. The operation fluid discharged from the first hydraulic pump P1 passes through the discharge fluid tube 27 and then is supplied to the first control valve 20A. In addition, the first control valve 20A is connected to the first hydraulic actuator 14 by a first fluid tube (a first fluid path) 21.

In particular, the first hydraulic actuator (the boom cylinder) 14 includes a cylinder body 14*a*, a piston 14*c* disposed inside the cylinder body 14*a*, and a rod 14*b* connected to the piston 14*c*, the piston 14*c* being capable of freely moving in an axial direction of the cylinder body 14*a*. The piston 14*c* divides an inside of the cylinder body (a cylinder tube) 14*a* into a first fluid chamber (a first oil chamber) 14*f* and a second fluid chamber (a second oil chamber) 14*g*. The first fluid chamber 14*f* is a fluid chamber disposed on a bottom side of the cylinder body 14*a* (on a side opposite to a side of the rod 14*b*).

The second fluid chamber 14*g* is a fluid chamber disposed on a rod side of the cylinder body 14*a*. A first port 14*d* is a port for supplying and discharging an operation fluid, and is disposed on a base end portion of the cylinder body 14*a* (on a side opposite to a side of the rod 14*b*), the first port 14*d* communicating with (being connected to) the first fluid chamber 14*f* A second port 14*e* is a port for supplying and discharging an operation fluid, and is disposed on a tip end of the cylinder body 14*a* (on the side of the rod 14*b*), the second port 14*e* communicating with (being connected to) the second fluid chamber 14*g*.

The first fluid tube 21 includes a first supply tube (a first supply path) 21*a* and a second supply tube (a second supply path) 21*b*. The first supply tube 21*a* connects the first port 14*d* to a first port 31 of the first control valve 20A. The second supply tube 21*b* connects the second port 14*e* to a second port 32 of the first control valve 20A.

Thus, when the first control valve 20A is switched to the first position 20*a*1, an operation fluid can be supplied from the first supply tube 21*a* to the first port 14*d* (the first fluid chamber 14*f*) of the boom cylinder 14, and an operation fluid can be discharged from the second port 14*e* (the second fluid chamber 14*g*) of the boom cylinder 14 to the second supply tube 21*b*.

In this manner, the boom cylinder 14 is stretched, and thus the boom 10 is moved upward. When the first control valve 20A is switched to the second position 20*a*2, an operation fluid can be supplied from the second supply tube 21*b* to the second port 14*e* (the second fluid chamber 14*g*) of the boom cylinder 14, and an operation fluid can be discharged from the first port 14*d* (the first fluid chamber 14*f*) of the boom cylinder 14 to the first supply tube 21*a*. In this manner, the boom cylinder 14 is shortened, and thus the boom 10 is moved downward.

The first control valve 20A additionally includes a first discharge port 33 and a second discharge port 34. The first discharge port 33 and the second discharge port 34 are connected to a discharge fluid tube (a discharge fluid path) 24, the discharge fluid tube 24 being connected to the operation fluid tank 15.

The second control valve 20B is a valve for controlling the hydraulic actuator (the bucket cylinder) 17, the bucket cylinder 17 being configured to move the bucket 11. The second control valve 20B is a three-position switch valve of a direct-acting spool type. The second control valve 20B is capable of being switched to a neutral position 20*b*3, a first position 20*b*1 other than the neutral position 20*b*3, and a second position 20*b*2 other than the neutral position 20*b*3 and the first position 20*b*1. The second control valve 20B is switched to the neutral position 20*b*3, the first position 20*b*1, and the second position 20*b*2 by a spool, the spool being operated by an operation member.

The spool meanwhile is moved directly by manually operating the operation member, and thus the movement of the spool switches the second control valve 20B. The spool however may be moved by a hydraulic operation (a hydraulic operation by a pilot valve and a hydraulic operation by a proportional valve), may be moved by an electric operation (an electric operation by magnetization of a solenoid), and may be moved by other methods. For convenience of description, the hydraulic actuator (the bucket cylinder) 17 may be referred to as the second hydraulic actuator 17.

The second control valve 20B is connected to the first control valve 20A by a first supplying-discharging fluid tube (a first supplying-discharging fluid path) 28*a* and a second supplying-discharging fluid tube (a second supplying-discharging fluid path) 28*b*. When the first control valve 20A is switched to the neutral position 20*a*3, an operation fluid is supplied to the second control valve 20B through the first supplying-discharging fluid tube 28*a*. When the first control valve 20A is switched to the first position 20*a*1 and to the second position 20*a*2, the operation fluid is supplied to the second control valve 20B through the second supplying-discharging fluid tube 28*b*.

The second control valve 20B is connected to the second hydraulic actuator 17 by a second fluid tube (a second fluid path) 22. In particular, the second hydraulic actuator (the bucket cylinder) 17 includes a cylinder body 17*a*, a piston 17*c* disposed inside the cylinder body 17*a*, and a rod 17*b* connected to the piston 17*c*, the piston 17*c* being capable of freely moving in an axial direction of the cylinder body 17*a*.

The piston 17*c* divides an inside of the cylinder body (a cylinder tube) 17*a* into a first fluid chamber (a first oil chamber) 17*f* and a second fluid chamber (a second oil chamber) 17*g*. The first fluid chamber 17*f* is a fluid chamber disposed on a bottom side of the cylinder body 17*a* (on a side opposite to a side of the rod 17*b*). The second fluid chamber 17*g* is a fluid chamber disposed on a rod side of the cylinder body 17*a*.

A first port 17*d* is a port for supplying and discharging an operation fluid, and is disposed on a base end portion of the cylinder body 17*a* (on a side opposite to a side of the rod 17*b*), the first port 17*d* communicating with (being connected to) the first fluid chamber 17*f*. A second port 17*e* is a port for supplying and discharging an operation fluid, and is disposed on a tip end of the cylinder body 17*a* (on the side of the rod 17*b*), the second port 17*e* communicating with (being connected to) the second fluid chamber 17*g*.

The second fluid tube 22 includes a first supply tube (a first supply path) 22*a* and a second supply tube (a first supply path) 22*b*. The first supply tube 22*a* is also referred to as a third supply tube (a third supply path) 22*a* in comparison with the first supply tube 21*a*. The second supply tube 22*b* is also referred to as a fourth supply tube (a fourth supply path) 22*b* in comparison with the second supply tube 21*b*. The first supply tube 22*a* connects the second port 17*e* to a first port 35 of the second control valve 20B. The second supply tube 22*b* connects the first port 17*d* to the second port 36 of the second control valve 20B.

Thus, when the second control valve 20B is switched to the first position 20*b*1, an operation fluid can be supplied from the first supply tube 22*a* to the second port 17*e* (the second fluid chamber 17*g*) of the bucket cylinder 17, and an operation fluid can be discharged from the first port 17*d* (the first fluid chamber 17*f*) of the bucket cylinder 17 to the second supply tube 22*b*. In this manner, the bucket cylinder 17 is shortened, and thus the bucket 11 provides a shoveling operation.

When the second control valve 20B is switched to the second position 20*b*2, an operation fluid can be supplied from the second supply tube 22*b* to the first port 17*d* (the first fluid chamber 17*f*) of the bucket cylinder 17, and an operation fluid can be discharged from the second port 17*e* (the second fluid chamber 17*g*) of the bucket cylinder 17 to the first supply tube 22*a*. In this manner, the bucket cylinder 17 is stretched, and thus the bucket 10 provides a dumping operation.

The third control valve 20C is a valve for controlling the hydraulic actuator (the hydraulic cylinder, the hydraulic motor, and the like) 16, the hydraulic actuator 16 being attached to the auxiliary attachment. The third control valve 20C is a three-position switch valve of a direct-acting spool type using the pilot fluid. The third control valve 20C is capable of being switched to a neutral position 20*c*3, a first position 20*c*1 other than the neutral position 20*c*3, and a second position 20*c*2 other than the neutral position 20*c*3 and the first position 20*c*1. The third control valve 20C is switched to the neutral position 20*c*3, the first position 20*c*1, and the second position 20*c*2 by a spool, the spool being operated by a pressure of the pilot fluid.

A connection member 18 is connected to the third control valve 20C by a supplying-discharging fluid tube 83*a* and a supplying-discharging fluid tube 83*b*. The connection member 18 is connected to fluid tubes (fluid paths) that are connected to the hydraulic actuator 16 of the auxiliary attachment.

Thus, when the third control valve 20C is switched to the first position 20*c*1, an operation fluid can be supplied from the supplying-discharging fluid tube 83*a* to the hydraulic actuator 16 of the auxiliary attachment. When the third control valve 20C is switched to the second position 20*c*2, an operation fluid can be supplied from the supplying-discharging fluid tube 83*b* to the hydraulic actuator 16 of the auxiliary attachment.

In this manner, an operation fluid is supplied from the supplying-discharging fluid tube 83*a* and the supplying-discharging fluid tube 83*b* to the hydraulic actuator 16, and thus the hydraulic actuator 16 (the auxiliary attachment) is operated.

The hydraulic system then includes a level control part (a level control device or a level control valve apparatus) 41, a ride control device (a accumulator apparatus) 52, and a control device (circuitry) 42.

The level control part 41 is a level control valve for providing a leveling operation (other operations) to the second hydraulic actuator (the bucket cylinder) 17. The level control part 41 includes an operation part (an operation device) 43, a first control part (a first control device or a first controller) 44, and a second control part (a second control device or a second controller) 45.

The operation part 43 is a valve configured to switch an operational state between a state (a first state) to stop the leveling operation and another state (a second state) to activate the leveling operation. In particular, the operation part 43 is a valve (an on-off valve) for switching the leveling operation, and for example is a two-position switch valve configured to be switched between a first position 43*a* to stop the leveling operation and a second position 43*b* to activate the leveling operation. The operation part 43 meanwhile may be not the switch valve but a proportional valve and further may be other valves.

In the embodiment, the operation part 43 is an electromagnetic switch valve configured to be switched to the first position 43 a by a spring and switched to the second position 43*b* by magnetizing a solenoid 43*c*. The operation part 43 meanwhile may be a switch valve configured to be manually switched to the first position 43*a* and to the second position 43*b*.

The operation part 43 is disposed on an intermediate portion of the first fluid tube 21 (the second supply tube 21*b*). When the operation part 43 is switched to the first position 43*a*, the operation part 43 allows an operation fluid to return in the first fluid tube 21 (the second supply tube 21*b*) from the first hydraulic actuator 14 toward the first control valve 20A, and allows an operation fluid to flow from the first control valve 20A toward the first hydraulic actuator 14.

That is, when the operation part 43 is switched to the first position 43*a*, the operation part 43 opens an intermediate portion of the first fluid tube 21 (the second supply tube 21*b*), and allows an operation fluid to flow mutually between a side of the first hydraulic actuator 14 and a side of the first control valve 20A. When the operation part 43 is at the first position 43*a*, that position stops the leveling operation.

In addition, when the operation part 43 is switched to the second position 43*b*, the operation part 43 blocks the flow of the operation fluid (a returning fluid) returning in the first fluid tube 21 (the second supply tube 21*b*) from the first hydraulic actuator 14 toward the first control valve 20A, and allows an operation fluid to flow from the first control valve 20A toward the first hydraulic actuator 14. When the operation part 43 is switched to the second position 43*b*, that position turns the leveling operation on (the leveling operation is activated).

The first control part 44 is a two-position switch valve configured to be switched to a first position 44*a* and to a second position 44*b*, the two-position switch valve being switched by a pressure of a pilot fluid. On the downstream of the first control part 44 and the operation part 43 (on a side close to the first hydraulic actuator 14), the first control part 44 is connected to the first fluid tube 21 (the second supply tube 21*b*) by a first flow tube (a first flow path) 46. An operation fluid in the first flow tube 46 applies a pressure to a pressure-receiving part (a pressure receptor) 44*c* of the first control part 44.

The second control part 45 is a three-position switch valve configured to be switched using the pilot fluid. The second control part 45 is capable of being switched to a first position 45*a*, a second position 45*b*, and a third position 45*c*. A second flow tube (a second flow path) 47 connects the first control part 44 to the second control part 45. A pressure of an operation fluid in the second flow tube 47 is applied to a pressure-receiving part (a pressure receptor) 45*d* of the second control part 45.

The second flow tube 47 meanwhile is connected to the first fluid tube 21 (the second supply tube 21*b*) at an upper stream of the operation part 43. In addition, a third flow tube 48 connects the second control part 45 to the second fluid tube 22 (the first supply tube 22*a*).

In this manner, when the second control part 45 is switched to the first position 43*a* (when the leveling operation is turned off), the first control valve 20A is switched to stretch and shorten the first hydraulic actuator (the boom cylinder) 14, and the second control valve 20B is switched to stretch and shorten the second hydraulic actuator (the bucket cylinder) 17.

When the second control part 45 is switched to the second position 43*b* (when the leveling operation is turned on), an operation fluid to return from the first hydraulic actuator (the boom cylinder) 14 (referred to as a boom -returning fluid) is blocked by the operation part 43 so as not to return from the first hydraulic actuator (the boom cylinder) 14 during the stretching of the first hydraulic actuator (the boom cylinder) 14, that is, the upward moving of the boom 10. The boom-returning fluid is applied to the pressure-receiving part 44*c* of the first control part 44 and to the pressure-receiving part 45*d* of the second control part 45. The first control part 44 and the second control part 45 are then switched, and thus the boom-returning fluid is applied to the second fluid tube 22 (the first supply tube 22*a*) through the third flow tube 48.

As the result of that, the boom-returning fluid dumps the second hydraulic actuator (the bucket cylinder) 17, that is, provides the leveling operation.

The ride control device 52 is a device configured to provide a ride control of the work machine 1. The ride control is a technique for suppressing fluctuation of a pressure of the first hydraulic actuator (the boom cylinder) 14, and thus the technique suppresses vibrations of the work machine 1 traveling (provides an anti-vibration operation to the machine body 2).

Explaining more specifically, when the work machine 1 travels to shake the bucket 11 upward and downward, the shaking of the bucket 11 fluctuates a pressure in the first fluid chamber 14*f* (the fluid chamber disposed on the bottom side) of the first hydraulic actuator 14. The ride control device 52 suppress the fluctuation of the pressure in the first fluid chamber 14*f* (the fluctuation is absorbed by an accumulator 53 described later), and thus suppresses the vibrations of the work machine 1 traveling.

The ride control device 52 includes the accumulator 53 and a ride control valve 54.

The accumulator 53 is a pressure-accumulating device configured to absorb the fluctuation of a pressure in the first fluid chamber 14*f* of the first hydraulic actuator (the boom cylinder) 14.

The ride control valve 54 is a switch valve configured to be switched to a stopping position to stop an operation of the ride control device 52 (a state not to provide the ride control) and to an activating position to activate the operation of the ride control device 52 (another state to provide the ride control). The ride control valve 54 is a two-position switch valve configured to be switched to a stopping position 54*a* where the ride control device 52 is stopped and to an activating position 54*b* where the ride control device 52 is activated.

In the embodiment, the ride control valve 54 is an electromagnetic switch valve configured to be switched to the stopping position 54*a* by a spring and to the activating position 54*b* by magnetizing a solenoid 54*c*. In addition, the ride control valve 54 is a switch valve having four ports (a four-port switch valve), a first port 54*d*, a second port 54*e*, a third port 54*f*, and a fourth port 54*g*.

The first port 54*d* is connected to the accumulator 53 by a fluid tube (a fluid path) 56*a*. The second port 54*e* is connected to a fluid tube (a fluid path) 56*b* that is a discharging fluid tube for discharging an operation fluid. The discharging fluid tube 56 is connected to the operation fluid tank 15. The third port 54*f* is connected to the first supply tube 21*a* by a fluid tube (fluid path) 56*c*.

That is, the third port 54*f* is connected to the first fluid chamber 14*f* of the first hydraulic actuator 14 by the fluid 56*c* and the first supply tube 21*a*. In other words, the ride control device 52 (the ride control valve 54) is connected to the first hydraulic actuator 14 (the first fluid chamber 14*f*) by the fluid tube 56*c* and the first supply tube 21*a*.

The fourth port 54*g* is connected to the first fluid tube 21 (the second supply tube 21*b*) between the level control part 41 (the operation part 43) and the first control valve 20A by a fluid tube (a fluid path) 56*d* that is a first fluid tube.

In particular, the fluid tube (the third fluid tube) 56*d* is connected to the ride control device 54 (the ride control valve 54) at one end of the fluid tube 56*d*, and is connected to the first fluid tube 21 (the second supply tube 21*b*) between the leveling control part 41 and the first control valve 20A at the other end of the fluid tube 56*d*. In other words, the ride control device 52 (the ride control valve 54) communicates with the first fluid tube 21 (the second supply tube 21*b*) between the level control part 41 and the first control valve 20A.

In addition, when the operation part 43 is switched to the fist position 43*a*, the fourth port 54*g* communicates with the second fluid chamber 14*g* of the first hydraulic actuator 14 through the fluid tube (the third fluid tube) 56*d* and the second supply tube 21*b*.

When the ride control device 54 is switched to the stopping position 54*a*, the communication between the first port 54*d* and the third port 54*f* is blocked at the position. In this manner, the communication between the first hydraulic actuator 14 (the first hydraulic chamber 140 and the accumulator 53 is blocked. In addition, when the ride control device 54 is switched to the stopping position 54*a*, the communication between the second port 54*e* and the fourth port 54*g* is blocked at the position. In this manner, the communication between the fluid tube (the third fluid tube) 56*d* and the fluid tube 56*b* (the tank 15) is blocked.

When the ride control valve 54 is switched to the stopping position 54*a*, the communication between the first fluid chamber 14*f* and the accumulator 53 is thus blocked. In this manner, the accumulator 53 absorbs no fluctuation of a pressure in the first fluid chamber 14*f*, and thus the ride control device 52 does not provide the anti-vibration operation (the ride control).

When the ride control device 54 is switched to the activating position 54*b*, the first port 54*d* communicates with the third port 54*f*. In this manner, the first hydraulic actuator 14 (the first fluid chamber 140 communicates with the accumulator 53. In addition, when the ride control device 54 is switched to the activating position 54*b*, the second port 54*e* communicates with the fourth port 54*g*. In this manner, the fluid tube (the third fluid tube) 56*d* communicates with the tank 15.

As described above, when the ride control valve 54 is switched to the activating position 54*b* and when the operation part 43 is switched to the first position 43*a*, the first fluid chamber 14*f* communicates with the accumulator 53 and further the second fluid chamber 14*g* communicates with the tank 15. In this manner, the accumulator 53 absorbs the fluctuation of the pressure in the first hydraulic chamber 14*f*, and thus the ride control device 52 provides the anti-vibration operation (the ride control).

And, the ride control valve 54 is arranged in the vicinity of the first control valve 20A. In this manner, the fluid tube (the third fluid tube) 56*d* can be easily connected to the first fluid tube 21 (the second supply tube 21*b*).

The control device 42 is constituted of a CPU and the like, and issues a command of a leveling control (the leveling operation) to the level control part 41 and a command of a ride control (the anti-vibration control) to the ride control device 52. For example, when the ride control device 52 is in operation, the control device 42 switches the operation part 43 to the state to stop the leveling operation and switches the operation part 43 to the state to activate the leveling operation. The control device 42 is connected to a detection device 58, to a first operation member 50, and to a second operation member 51.

The detection device 58 is a device configured to detect an operation moving the boom 10 upward (the stretching of the boom cylinder 14). The detection device 58 is, for example, a sensor configured to detect an operation moving an operation member toward a direction to move the boom 10 upward, the operation member being used for operating the boom 10 (the first control valve 20A).

The detection device 58 meanwhile may be one of devices configured to detect the upward moving of the boom 10 (a boom upward movement). For example, the detection device 58 may be a rotary potentiometer configured to detect an upward turn of the boom 10, a linear potentiometer configured to detect the stretching of the boom cylinder 14, and a sensor configured to detect a position of the spool of the first control valve 20A. In addition, the detection device 58 may be a device configured to detect the boom upward movement and a boom downward movement (the downward moving of the boom 10).

The first operation member 50 is a member used for an operation to switch the ride control valve 54. For example, the first operation member 50 is constituted of a switch to be operated by an operator. When the first operation member 50 is turned on (operated), the control device 42 outputs a magnetization command to the solenoid 54*c*.

In this manner, the ride control valve 54 is switched to the activating position 54*b*, the ride control device 52 activates the anti-vibration operation to the machine body 2. When the first operation member 50 is turned off (in a state not to be operated), the control device 42 outputs a demagnetization command to the solenoid 64*c*, that is, does not output the magnetization command to the solenoid 54*c*.

In this manner, the ride control valve 54 is switched to the stopping position 54*b*, and thus the ride control device 52 stops the anti-vibration operation to the machine body 2.

The ride control valve 54 meanwhile may be switched (may activate and stop the ride control) automatically. For example, a speed sensor may be disposed on the work machine 1, the speed sensor being configured to detect a speed of the work machine 1. When the work machine 1 is at a predetermined speed or more, the control device 42 outputs the magnetization command to the solenoid 54*c*. And, when the work machine 1 is at less than the predetermined speed, the control device 42 outputs the demagnetization command to the solenoid 54*c*. In addition, the ride control valve 54 may be switched automatically depending on other conditions.

The second operation member 51 is a member used for an operation to switch the operation part 43. For example, the second operation member 51 is constituted of a switch to be operated by an operator. When the second operation member 51 is turned off (in a state not to be operated), the solenoid 43*c* is demagnetized, and the operation part 43 is at the first position 43*a*.

When the second operation member 51 is turned on (operated), the control device 42 outputs a magnetization command to the solenoid 43*c*. In this manner, the operation part 43 is switched to the second position 43*b*, the level control part 41 activates the leveling operation. The control device 42 meanwhile may output the magnetization command to the solenoid 43*c* when the detection device 58 detects the boom upward movement (the turning movement of the boom 10) under a state where the second operation member 51 is turned on.

In that case, even when the second operation member 51 is turned on, the solenoid 43*c* is still demagnetized until the detection device 58 detects the boom upward movement (the turning movement of the boom 10), and thus the leveling operation is not activated (the leveling operation is still stopped).

In addition, in the case where the first operation member 50 is turned on (where the ride control device 52 provides the anti-vibration operation), the control device 42 does not magnetize the solenoid 43*c* of the operation part 43 (turns the operation part 43 off) when the turning on of the second operation member 51 (a command to activate the leveling operation) is inputted to the control device 42.

That is, the control device 42 does not activate the leveling operation and stops the leveling operation (magnetizes the solenoid 43*c* of the operation part 43) when the anti-vibration operation and the leveling operation are turned on by the first operation member 50 and the second operation member 51. In other words, the control device 42 forbids the activation of the leveling operation when the anti-vibration operation is turned on and the leveling operation is turned on by the first operation member 50 and the second operation member 51.

For example, in the case where the anti-vibration is activated, the control device 42 does not issue a command to the level control part 41, the command being to start the leveling operation, when the second operation member 51 used for activating the leveling operation is set from the turning off position to the turning on position. In addition, in a case where the leveling operation is activated under a state where the second operation member 51 used for activating the leveling operation is set to the turning on position, the control device 42 issues a command to the level control part 41, the command being to forbid (stop) the leveling operation (being to magnetize the solenoid 43*c* of the operation part 43) when the first operation member 50 used for activating the anti-vibration operation is set from the turning off position to the turning on position.

As described above, the fourth port 54*g* is connected to the second supply tube 21*b* by the fluid tube 56*d* between the level control part 41 (the operation part 43) and the first control valve 20A. In this manner, in the case where the operation part 43 is at the first position 43*a*, the boom-returning fluid from the second fluid chamber 14*g* in the upward moving of the boom 10 can firstly pass through the operation part 43, and then flow to the ride control valve 54 passing through the fluid tube 56*d*. Thus, the ride control device 52 is capable of providing the anti-vibration operation certainly.

In a case where the first operation member 50 is set to the position to turn the anti-vibration operation off (inactivate the anti-vibration operation), the bucket 11 can be held horizontally in the upward movement of the boom 10 when the second operation member 51 is set to the position to turn the leveling operation on (activate the leveling operation).

That is, the leveling operation can be appropriately provided. Even in a case where the first operation member 50 is set to the position to activate the anti-vibration operation and the second operation member 51 is set to the position to activate the leveling operation, the control device 42 does not switch the operation part 43 to the second position 43*b*. In this manner, a fluid returning from the boom cylinder 14 can be discharged to the operation fluid tank 15, and thus the anti-vibration operation can be appropriately provided.

(Second Embodiment)

Figure 2:
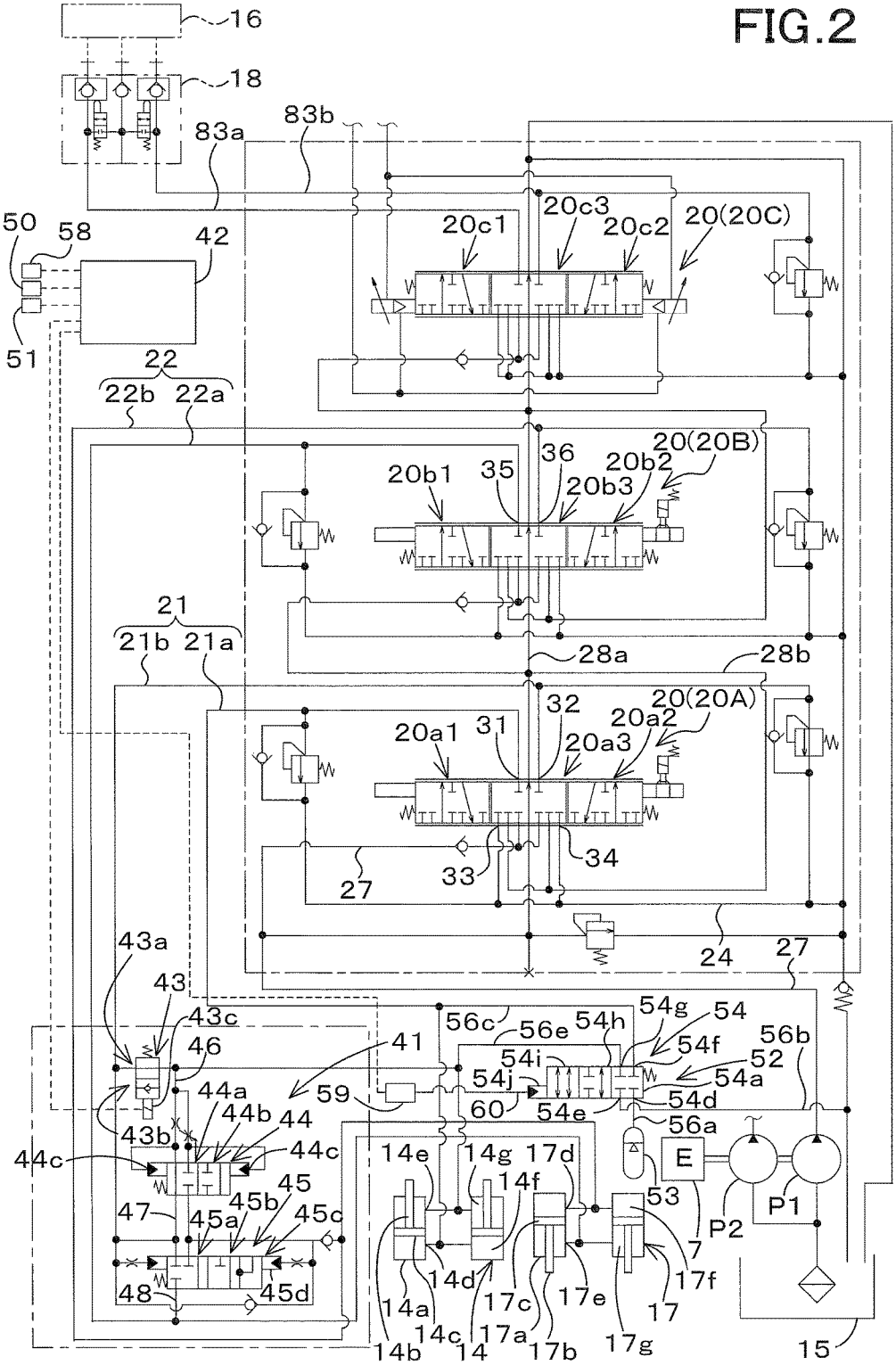
FIG. 2 is a view illustrating a hydraulic system (a hydraulic circuit) according to a second embodiment of the present invention.

FIG. 2 illustrates a hydraulic system according to a second embodiment of the present invention. Explanations of components similar to the components of the first embodiment will be omitted by being given reference numerals identical to the reference numerals of the first embodiment. In the second embodiment, components different from the components of the first embodiment will be explained mainly.

In the second embodiment, the ride control device 52 is configured to be switched to a stopping state to stop the anti-vibration operation, to a first activating state to activate both of the leveling operation and the anti-vibration operation, and to a second activating state to activate the anti-vibration operation.

As shown in FIG. 2, the ride control valve 54 is a three-position switch valve configured to be switched to the stopping position 54*a*, to a first activating position 54*h*, and to a second activating position 54*i*. The stopping position 54*a* is to set the ride control device 52 to the stopping state. The first activating position 54*h* is to set the ride control device 52 to the first activating state. The second activating position 54*i* is to set the ride control device 52 to the second activating state.

In addition, the ride control valve 54 is a pilot-operation switch valve configured to be switched to the stopping position 54*a* by a spring and switched to the first activating position 54*h* and the second activating position 54*i* by an operation fluid (a pilot fluid) supplied to a pressure-receiving part (a pressure receptor) 54*j*. The ride control valve 54 is a four-port switch valve having the first port 54*d*, the second port 54*e*, the third port 54*f*, and the fourth port 54*g* as in the first embodiment.

In the second embodiment, the fourth port 54*g* is connected to the first fluid tube 21 (the second supply tube 21*b*) by a fluid tube 56*e* between the level control part 41 (the operation part 43) and the first hydraulic actuator 14 (the second fluid chamber 14*g*). The connections of the other ports are similar to the connections of the ports in the first embodiment.

At the stopping position 54*a*, the ride control valve 54 provides operations similar to the operations of the first embodiment. It is different from the first embodiment to block the communication between the second fluid chamber 14*g* and the tank 15 by blocking the communication between the fluid tube 56*e* and the fluid tube (the discharging fluid tube) 56*b*.

At the first activating position 54*h*, the first port 54*d* communicates with the third port 54*f*. In this manner, the first hydraulic actuator 14 (the first fluid chamber 14*f*) communicates with the accumulator 53. In addition, at the first activating position 54*h*, the communication between the second port 54*e* and the fourth port 54*g* is blocked. In this manner, the communication between the fluid tube 56*e* and the fluid tube 56*b* is blocked, and the communication between the second fluid chamber 14*g* and the tank 15 is blocked.

Thus, when the ride control valve 54 is switched to the first activating position 54*h*, the first fluid chamber 14*f* communicates with the accumulator 53, and then the ride control device 52 provides the anti-vibration operation (the ride control). However, since the communication between the second fluid chamber 14*g* and the tank 15 is blocked, the anti-vibration operation (the ride control) is not provided so efficiently compared to the case where the second fluid tube 14*g* communicates with the tank 15.

At the second activating position 54*i*, the first port 54*d* communicates with the third port 54*f*, and the second port 54*e* communicates with the fourth port 54*g*. In this manner, the first fluid chamber 14*f* communicates with the accumulator 53, and the second fluid chamber 14*g* communicates with the tank 15.

Thus, when the ride control valve 54 is switched to the second activating position 54*i*, the accumulator 53 absorbs the fluctuation of a pressure in the first fluid chamber 14*f*. In this manner, the ride control device 52 provides the anti-vibration operation (the ride control).

In addition, the hydraulic system according to the second embodiment includes an operation valve 59. The operation valve 59 is connected to the control device 42. The operation valve 59 is an electromagnetic proportional valve configured to output an operation fluid pressure (a pilot pressure) used for switching the ride control valve 54 to the first activating position 54*h* and to the second activating position 54*i*. The operation valve 59 is connected to the pressure-receiving part 54*j* by the fluid tube 60.

In the second embodiment, when the second operation member 51 is turned on, the control device 42 outputs a magnetization command to the solenoid 43*c*, and then the operation part 43 is switched to the second position 43*b*. In addition, when the second operation member 51 is turned off, the solenoid 43*c* is demagnetized to be switched to the first position 43*a*.

The control device 42 is switched to the first activating position 54*h* when the first operation member 50 is turned on and the detection device 58 detects the boom upward movement (the turning movement of the boom 10) (when the boom cylinder 14 is operated) under a state where the second operation member 51 is turned on.

The communication between the second port 54*e* and the fourth port 54*g* is blocked at the first activating position 54*h*, and thus the boom returning fluid does not pass through the ride control valve 54 and thus is not leaked to the tank 15, the boom returning fluid flowing from the second fluid chamber 14*g* in the upward movement of the boom 10. Thus, the boom returning fluid flows to the level control part 41, the boom returning fluid flowing from the second fluid chamber 14*g* in the upward movement of the boom 10, and thus the leveling operation is activated even when the ride control device 52 is in operation.

In addition, the control device 42 is switched to the second activating position 54*i* when the first operation member 50 is turned on and the detection device 58 does not detect the boom upward movement (the turning movement of the boom 10) (when the boom cylinder 14 is not operated) under a state where the second operation member 51 is turned on. At the operation positon 54*i*, the first fluid chamber 14*f* communicates with the accumulator 53, and the second fluid chamber 14*g* communicates with the tank 15. The anti-vibration operation is thus provided well.

According to the second embodiment, the ride control valve 54 has the first activating position 54*h* where the communication between the second fluid chamber 14*g* and the tank 15 is blocked and the first fluid chamber 14*f* communicates with the accumulator 53, and thus the ride control valve 54 is switched to the first activating position 54*h* in the boom upward movement (when the leveling operation is requested).

In this manner, the leveling control normally works in the operation of the ride control device 52 without sacrificing the operation of the ride control device 52.

In addition, the ride control valve 54 has the second activating position 54*i* where the second fluid chamber 14*g* communicates with the tank 15 and the first fluid chamber 14*f* communicates with the accumulator 53, and thus the ride control valve 54 is switched to the second activating position 54*i* not in the boom upward movement (when the leveling operation is not requested).

In this manner, the ride control device 52 provides well the anti-vibration operation to the machine body 2. In this manner, the leveling operation and the anti-vibration operation (the ride control) both can be provided appropriately.

Figure 3:
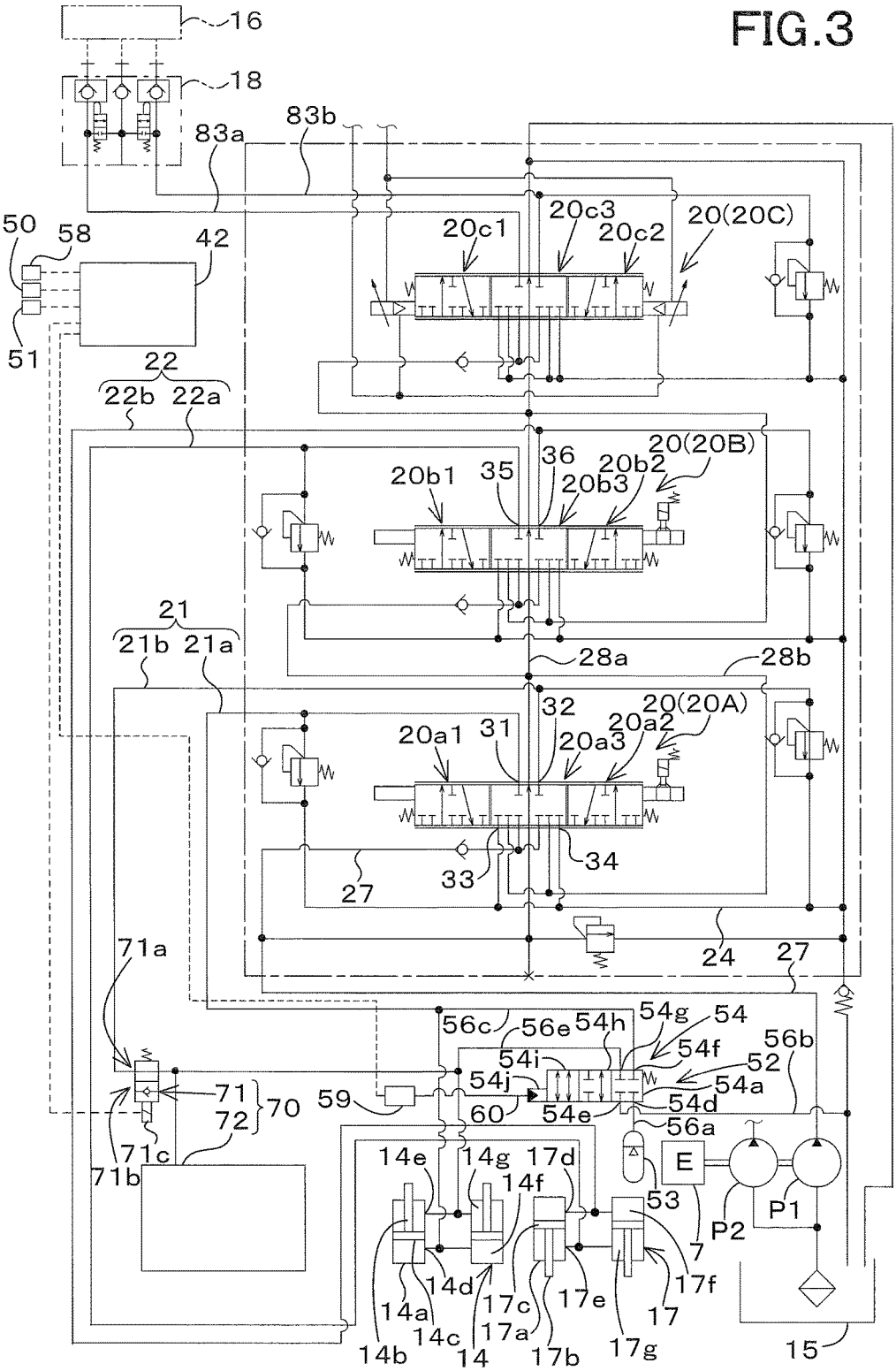
FIG. 3 is a view illustrating a modified embodiment of a hydraulic system (a hydraulic circuit) according to the second embodiment.

The ride control device 52 meanwhile is applied to the leveling control part 41 and to the boom cylinder (the first hydraulic actuator) 14; instead of the configuration, the ride control device 52 however may be applied to the hydraulic actuator (the second hydraulic actuator) other than the level control part 41 and to the boom cylinder (the first hydraulic actuator) 14. FIG. 3 illustrates a modified embodiment of the ride control device 52.

As shown in FIG. 3, the hydraulic system includes the boom cylinder (the first hydraulic actuator) 14 and a second hydraulic actuator 70. The second hydraulic actuator 70 is a hydraulic apparatus disposed for various operations of the work machine 1. The second hydraulic actuator 70 includes an operation part 71 and a moving part 72. The moving part 72 is a portion for various movements such as the stretching and shortening, the revolving, and the inclining.

The operation part 71 is a valve configured to be switched to a state to stop the moving part 72 (a stopping state) and to a state to enable the moving part 72 to be activated. In particular, the operation part 71 is an on-off valve, for example, a two-position switch valve configured to be switched to a first position 71*a* and to a second position 71*b*. The operation part 71 meanwhile may be not a switch valve but a proportional valve and another valve. In the embodiment, the operation part 71 is an electromagnetic switch valve configured to be switched to the first position 71*a* by a spring and switched to the second position 71*b* by magnetizing a solenoid 71*c*.

The operation part 71 is disposed on an intermediate portion of the first fluid tube 21 (the second supply tube 21*b*). When the operation part 71 is switched to the first position 71*a*, the operation part 71 allows an operation fluid to flow from the first hydraulic actuator 14 toward the first control valve 20A in the first fluid tube 21 (the second supply tube 21*b*) and allows the operation fluid to flow from the first control valve 20A toward the first hydraulic actuator 14.

In particular, when the operation part 71 is switched to the first position 71*a*, the operation part 71 opens the intermediate portion of the first fluid tube 21 (the second supply tube 21*b*), and thus allows the operation fluid to mutually between a side of the first hydraulic actuator 14 and a side of the first control valve 20A. When the operation part 71 is at the first position 71*a*, the moving part 72 does not move.

The ride control device 52 is a device configured to be switched to the stopping state to stop the anti-vibration operation, to a first activating state to activate both of the operation of the second hydraulic actuator 70 (other operations) and the anti-vibration operation, and to a second activating state to activate the anti-vibration operation. The ride control device 52 has the configurations similar to the configurations of the embodiments mentioned above. In the case of the modified example illustrated in FIG. 3, the first hydraulic actuator is not limited to the boom cylinder 14.

(Third Embodiment)

Figure 4:
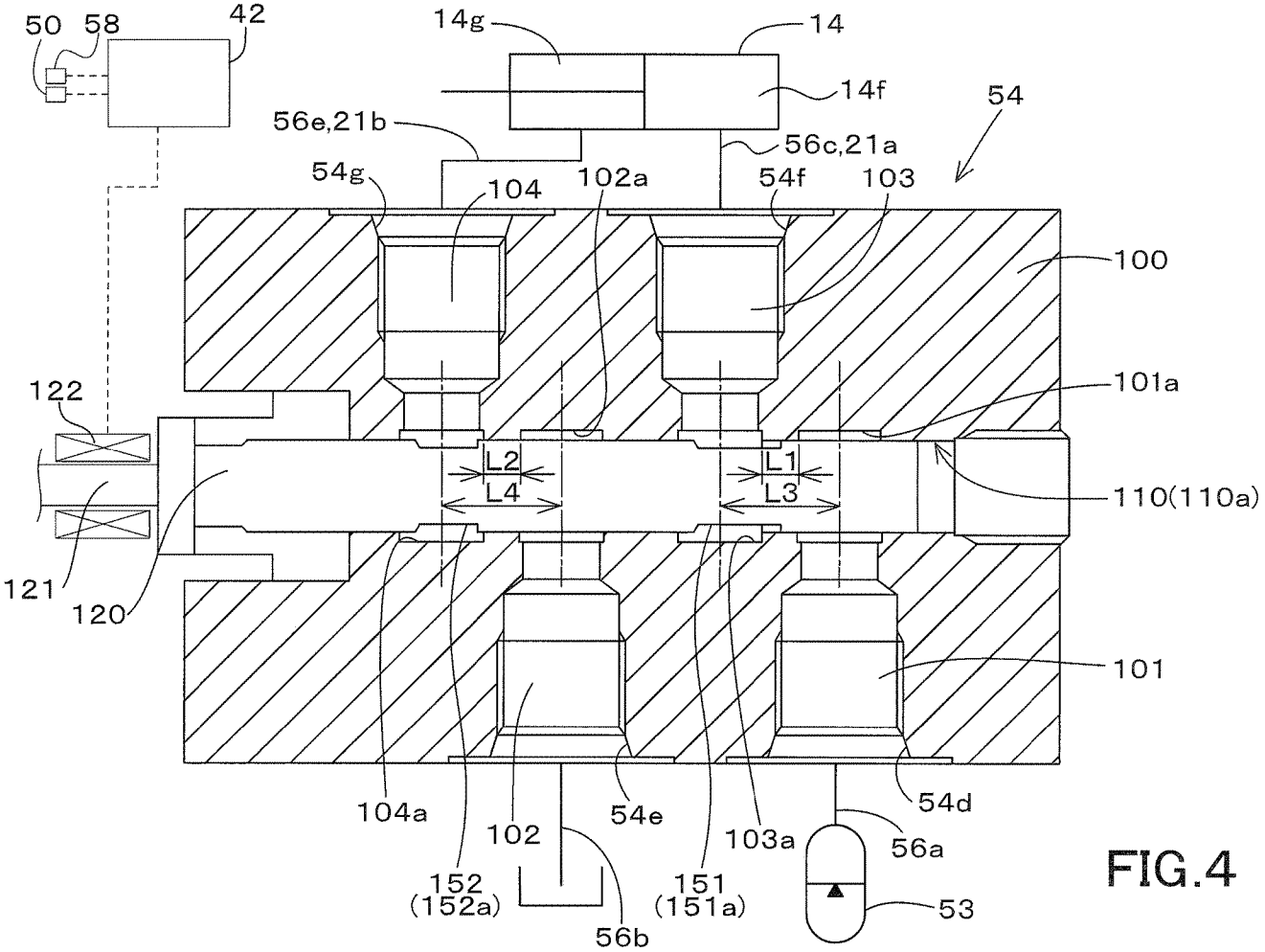
FIG. 4 is a view illustrating a ride control valve according to a third embodiment of the present invention.

FIG. 4 illustrates an inner configuration of a ride control valve according to a fourth embodiment of the present invention. Explanations of components of a hydraulic system (a hydraulic circuit) similar to the components of the first embodiment and the second embodiment will be omitted by being given reference numerals identical to the reference numerals of the first embodiment and the second embodiment. In the third embodiment, components different from the components of the first embodiment and the second embodiment will be explained mainly.

The ride control valve according to the third embodiment can be applied to the hydraulic systems of the first embodiment and the second embodiment. In addition, the ride control valve according to the third embodiment can be applied to the hydraulic systems other than the hydraulic systems of the first embodiment and the second embodiment.

As shown in FIG. 4, the ride control valve 54 includes a main body 100. The main body 100 is formed of cast iron, resin, and the like. The main body 100 includes a flow tube (a flow path) for supplying an operation fluid. For convenience of description, the fluid tube included in the main body 100 and the like is referred to as a connection flow tube (a connection flow path) in the third embodiment. For convenience of description, a left side of the sheet surface of FIG. 4 is referred to as the left, a right side of the sheet surface is referred to as the right, directions toward the left and the right are referred to as a lateral direction (a horizontal direction), and a direction perpendicular to the lateral direction is referred to as a longitudinal direction.

The main body 100 includes a first connection flow tube (a first connection flow path) 101, a second connection flow tube (a second connection flow path) 102, a third connection flow tube (a third connection flow path) 103, and a fourth connection flow tube (a fourth connection flow path) 104.

The first connection flow tube 101 is a flow tube that communicates with a fluid tube (a connection fluid tube) 56*a* connected to the accumulator 53. A first port 54*d* is disposed on a right portion of the main body 100 in the lateral direction, and the first connection flow tube 101 is formed sequentially from the first port 54*d*. The first connection flow tube 101 is arranged extending at least in the longitudinal direction. The first connection flow tube 101 has a cylindrical shape.

The second connection flow tube 102 is a flow tube that communicates with a fluid tube (a connection fluid tube) 56*b* used for discharging an operation fluid. A second port 54*e* is disposed on a left portion of the main body 100 in the lateral direction, and the second connection flow tube 102 is formed sequentially from the second port 54*e*. The second connection flow tube 102 is arranged extending at least in the longitudinal direction. The second connection flow tube 102 has a cylindrical shape.

The third connection flow tube 103 is a flow tube that communicates with a fluid tube (a third connection fluid tube) communicating with the first fluid chamber 14*f* of the first hydraulic actuator 14. A third port 54*f* is disposed on the right portion of the main body 100 in the lateral direction, and the third connection flow tube 103 is formed sequentially from the third port 54*f*. The third connection flow tube 103 is arranged extending at least in the longitudinal direction.

The third connection fluid tube meanwhile includes the fluid tube 56*c* and the first supply tube 21*a;* however, a fluid tube extending from the third port 54*f* to the first fluid chamber 14*f* is not limited to the fluid tube 56*c* and the first supply tube 21*a*. The third connection flow tube 103 has a cylindrical shape.

The fourth connection flow tube 104 is a flow tube that communicates with a fluid tube (a fourth connection fluid tube) communicating with the second fluid chamber 14*g* of the first hydraulic actuator 14. A fourth port 54*g* is disposed on a left portion of the main body 100 in the lateral direction, and the fourth connection flow tube 104 is formed sequentially from the fourth port 54*g*. The fourth connection flow tube 104 is arranged extending at least in the longitudinal direction. The fourth connection flow tube 104 has a cylindrical shape.

The fourth connection fluid tube meanwhile includes the fluid tube 56*e* and the second supply tube 21*b;* however, a fluid tube extending from the fourth port 54*g* to the second fluid chamber 14*g* is not limited to the fluid tube 56*e* and the second supply tube 21*b*.

In addition, the main body 100 includes a wall portion 110 (a through hole 110*a*) having a circular shape (a track shape), the wall portion 110 extending from one end (a left end) of the main body 100 to the other end (a right end) in the lateral direction. That is, the through hole 110*a* is a straight hole used for inserting a spool 120 that is formed to have a cylindrical shape. The first connection fluid tube 101, the second connection fluid tube 102, the third connection fluid tube 103, and the fourth connection fluid tube 104 reach the wall portion 110 having a circular shape and constituting the through hole 110*a*. An end portion 101*a* of the first connection flow tube 101 reaches the wall portion 110.

An end portion 102*a* of the second connection flow tube 102 reaches the wall portion 110. An end portion 103*a* of the third connection flow tube 103 reaches the wall portion 110. An end portion 104*a* of the fourth connection flow tube 104 reaches the wall portion 110. The end portion 101*a*, the end portion 102*a*, the end portion 103*a*, and the end portion 104*a* have a concaved shape in a cross sectional view. In addition, each of the end portion 101*a*, the end portion 102*a*, the end portion 103*a*, and the end portion 104*a* is constituted of a peripheral wall and side walls, the peripheral wall being formed around an axis of each of the flow tubes, the side walls being disposed on both ends of the peripheral wall in the lateral direction.

The shortest distance L1 between the end portion 101*a* and the end portion 103*a* is substantially equal to the shortest distance L2 between the end portion 102*a* and the end portion 104*a*. In other words, a distance L3 from a center of the end portion 101*a* to a center of the end portion 103*a* in the lateral direction is substantially equal to a distance L4 from a center of the end portion 102*a* to a center of the end portion 104*a* in the lateral direction.

The spool 120 moves inside the main body 100, and thus changes a connection partner of each of the first connection flow tube 101, the second connection flow tube 102, the third connection flow tube 103, and the fourth connection flow tube 104. The spool 120 will be explained below in detail.

The spool 120 is formed to have a cylindrical shape. The spool 120 having the cylindrical shape is inserted into the through hole 110*a* that is formed inside the main body 100. An elastic member such as a spring is disposed between the main body 100 and the left end of the spool 120, and thus the spool 120 is pushed toward the left. A rod 121 is connected to an outer surface of the left end of the spool 120, the rod 121 being configured to move in the lateral direction.

When a solenoid 122 of the ride control valve 54 is magnetized and demagnetized, the rod 121 moves rightward and leftward. When the rod 121 is moved rightward and leftward, the spool 120 is moved inside the main body 100. The embodiment meanwhile explains an example of the configuration of the ride control valve 54 that is constituted of an electromagnetic valve having the solenoid 122. However, the ride control valve 54 may be a valve other than the electromagnetic valve.

As shown in FIG. 4, the spool 120 includes a first connection part (a first connector) 151 and a second connection part (a second connector) 152. The first connection part 151 is capable of connecting the first connection flow tube 101 to the third connection flow tube 103. In particular, the first connection part 151 includes a first groove 151*a*. The first groove 151*a* is a portion formed by circularly denting a circumference surface of a right portion of the spool 120. The first groove 151*a* is a groove having a rectangular shape in a cross sectional view.

Figure 5A:
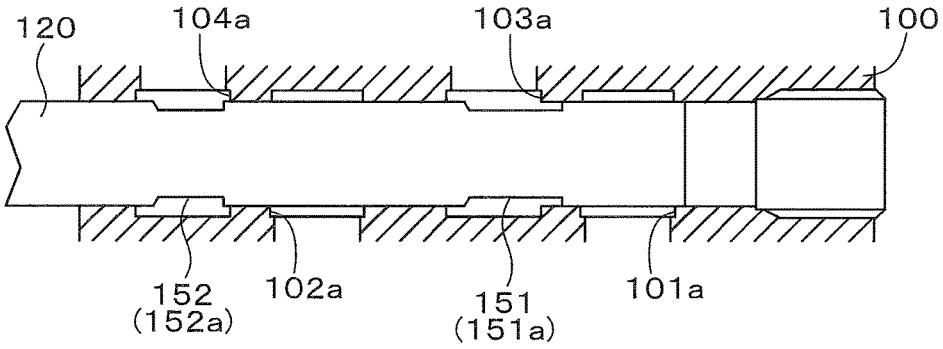
FIG. 5A is a cross section view illustrating the ride control valve according to the third embodiment, the cross section view illustrating a stopping position.

As shown in FIG. 5A, the first groove 151*a* is not overlapped with (does not correspond to) both of the end portion 101*a* of the first connection flow tube 101 and the end portion 103*a* of the third connection flow tube 103, that is, the ride control valve 54 is switched to the stopping position 54*a*, and thus the first groove 151*a* blocks the connection between the first connection flow tube 101 and the third connection flow tube 103.

Figure 5B:
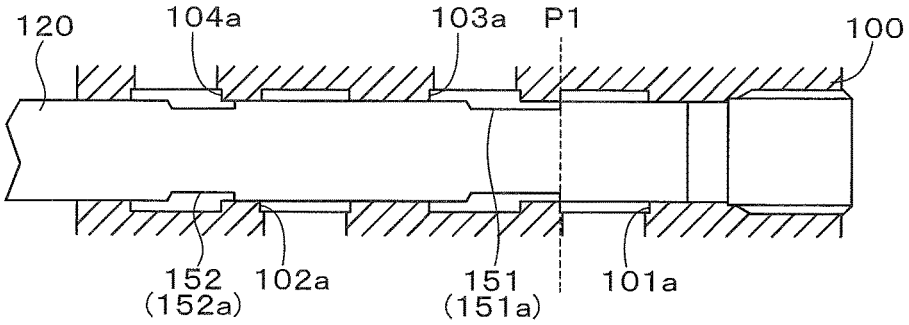
FIG. 5B is a cross section view illustrating the ride control valve according to the third embodiment, the cross section view illustrating a first starting position.
Figure 5C:
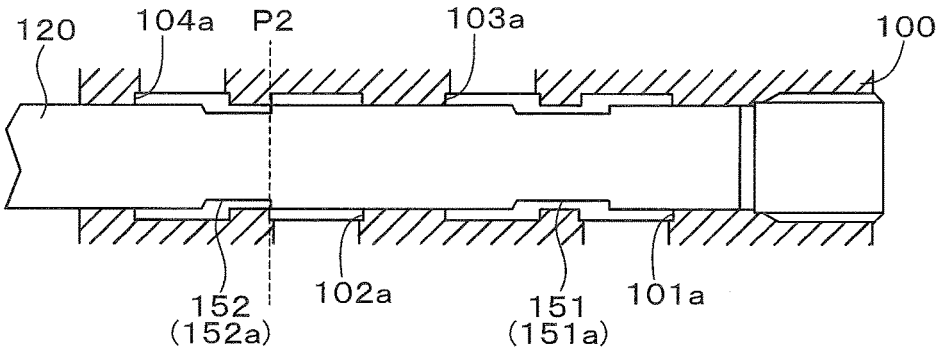
FIG. 5C is a cross section view illustrating the ride control valve according to the third embodiment, the cross section view illustrating a second starting position.
Figure 5D:
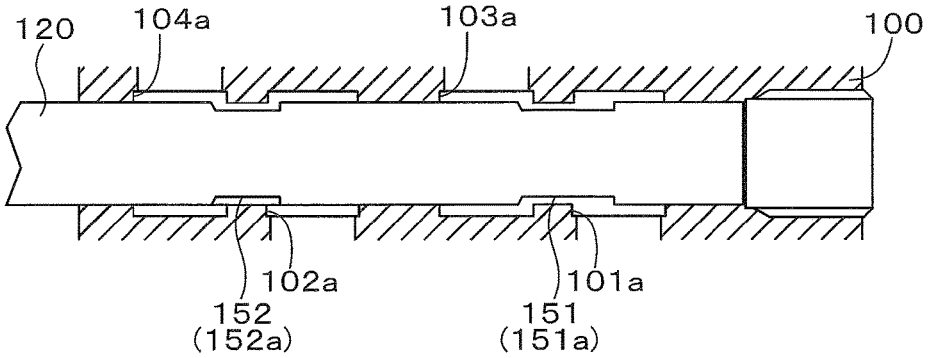
FIG. 5D is a cross section view illustrating the ride control valve according to the third embodiment, the cross section view illustrating an activating position of a case where a spool is fully stroked.

As shown in FIG. 5B to FIG. 5D, the spool 120 is moved from the position shown in FIG. 5A, and then the first groove 151*a* is overlapped with (does not correspond to) both of the end portion 101*a* of the first connection flow tube 101 and the end portion 103 a of the third connection flow tube 103. That is, the ride control valve 54 is switched to the activating position 54*b*, and thus the first groove 151*a* connects the first connection flow tube 101 to the third connection flow tube 103.

As shown in FIG. 4, the second connection part 152 is capable of connecting the second connection flow tube 102 to the fourth connection flow tube 104. In particular, the second connection part 152 includes a second groove 152*a*. The second groove 152*a* is a portion formed by circularly denting a circumference surface of a left portion of the spool 120. The second groove 152*a* is a groove having a rectangular shape in a cross sectional view.

As shown in FIG. 5A, the second groove 152*a* is not overlapped with (does not correspond to) both of the end portion 102*a* of the second connection flow tube 102 and the end portion 104*a* of the fourth connection flow tube 104, that is, the ride control valve 54 is switched to the stopping position 54*a*, and thus the second groove 152*a* blocks the connection between the second connection flow tube 102 and the fourth connection flow tube 104.

As shown in FIG. 5B to FIG. 5D, the spool 120 is moved from the position shown in FIG. 5A, and then the second groove 152*a* is overlapped with (does not correspond to) both of the end portion 102*a* of the second connection flow tube 102 and the end portion 104*a* of the fourth connection flow tube 104. That is, the ride control valve 54 is switched to the activating position 54*b*, and thus the second groove 152*a* connects the second connection flow tube 102 to the fourth connection flow tube 104.

In the ride control valve 54 according to the second embodiment, a timing when the first hydraulic actuator 14 (the first fluid chamber 14*f*) is connected to the accumulator 53 is different from a timing when the first hydraulic actuator 14 (the second fluid chamber 14*g*) is connected to the fluid tube 56*b*.

That is, the spool 120 has a first starting position and a second starting position different from the first starting position, the first starting position being to start connecting the first connection flow tube 101 to the third connection flow tube 103, the second starting position being to start connecting the second connection flow tube 102 to the fourth connection flow tube 104.

As shown in FIG. 5A, when the ride control valve 54 is switched to the stopping position 54*a*, the first groove 151*a* is not overlapped with the end portion 101*a* of the first connection flow tube 101, and the second groove 152*a* also is not overlapped with the end portion 102*a* of the second connection flow tube 102. When the spool 120 is moved rightward from the position shown in FIG. 5A, the first groove 151*a* and the second groove 152*a* both move rightward in accordance with the movement of the spool 120.

As shown in FIG. 5B, the right end of the first groove 151*a* firstly corresponds to (meets) the end portion 101*a* of the first connection tube 101 at a point P1, and the point P1 is the first starting position to start connecting the first connection flow tube 101 to the third connection flow tube 103. The right end of the second groove 152*a* is positioned leftward from the left end of the end portion 102*a* of the second connection flow tube 102, and thus the second groove 152*a* is not overlapped with the second connection flow tube 102.

In addition, when the spool 120 is further moved rightward from the position shown in FIG. 5B, the right end of the second groove 152*a* firstly corresponds to (meets) the second connection tube 102 at a point P2, and the point P2 is the second starting position to start connecting the second connection flow tube 102 to the fourth connection flow tube 104.

In this manner, the spool 120 is moved without connecting the first hydraulic actuator 14 (the first fluid chamber 14f) to the accumulator 53 and without connecting the first hydraulic actuator 14 (the second fluid chamber 14g) to the discharging fluid tube 56*b* (that is, in a non-connection state), and then the first fluid chamber 14*f* is connected to the accumulator 53 before the second fluid chamber 14*g* is connected to the discharging fluid tube 56*b*.

As described above, the ride control valve 54 connects the first connection flow tube 101 to the third connection flow tube 103, and thereby makes the first fluid chamber 14*f* of the first hydraulic actuator 14 communicate with the accumulator 53. And, the ride control valve 54 connects the second connection flow tube 102 to the fourth connection flow tube 104, and thereby makes the second fluid chamber 14*g* of the first hydraulic actuator 14 communicate with the discharging fluid tube 56*b*.

As shown in FIG. 5B and the others, the ride control valve 54 is capable of making a communication between the first communication flow tube 101 and the third connection flow tube 103 and blocking a communication between the second communication flow tube 102 and the fourth connection flow tube 104. Thus, it is preferable for the spool 120 to be held making the communication between the first communication flow tube 101 and the third connection flow tube 103 and blocking the communication between the second connection flow tube 102 and the fourth connection flow tube 104.

For example, when the first operation member 50 is turned on and the detection device 58 detects the boom upward movement (the turning movement of the boom 10) (that is, the boom cylinder 14 is operated), the control device 42 operates the ride control valve 54 to hold the state to make the communication between the first connection flow tube 101 and the third connection flow tube 103 and block the communication between the second connection flow tube 102 and the fourth connection flow tube 104.

In addition, when the first operation member 50 is turned on and the detection device 58 detects the boom downward movement (the turning movement of the boom 10) (that is, the boom cylinder 14 is operated), the control device 42 operates the ride control valve 54 to hold the state to make the communication between the first connection flow tube 101 and the third connection flow tube 103 and block the communication between the second connection flow tube 102 and the fourth connection flow tube 104.

That is, in the upward movement and downward movement of the boom cylinder 14 that is the first hydraulic actuator 14, the ride control valve 54 is capable of holding the state to make the communication between the first connection flow tube 101 and the third connection flow tube 103 and block the communication between the second connection flow tube 102 and the fourth connection flow tube 104. In FIG. 5A to FIG. 5C, the first starting position P1 is different from the second starting position P2; however, the shortest distance L1 may be different from the shortest distance L2. That is, the distance L3 may be different from the distance L4.

Figure 6A:
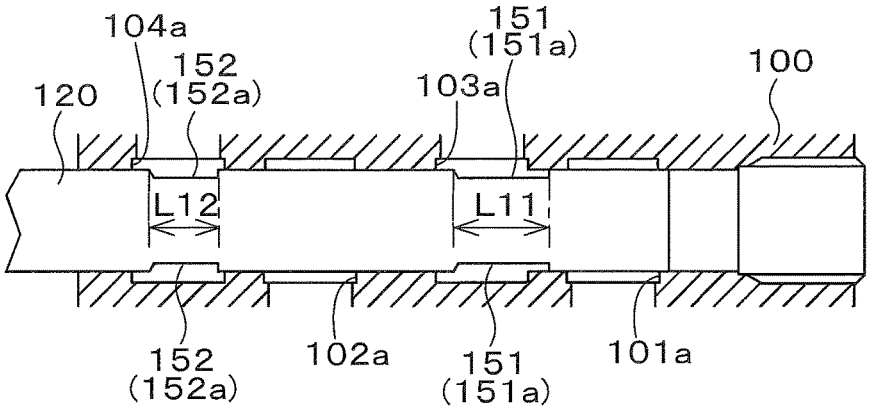
FIG. 6A is a cross section view illustrating the ride control valve according to the third embodiment, the cross section view explaining lengths of a first groove and a second groove.

FIG. 6A illustrates a modified example of the ride control valve 54. In the modified example of FIG. 6A, the first groove 151*a* has a length different from a length of the second groove 152*a*. In particular, a length L11 of the first groove 151*a* is configured to be longer than a length L12 of the second groove 152*a*. The length L11 and length L12 meanwhile are lengths extending along an axial of the spool 12, that is, lengths in the lateral direction. In addition, the shortest distance L1 is substantially equal to the shortest distance L2 (the distance L3 is substantially equal to the distance L4).

Also in the modified example shown in FIG. 6A, when the spool 120 is moved from the non-connection state, the first groove 151*a* is overlapped with the end portion 101*a* of the first connection flow tube 101 before the second groove 152*a* is overlapped with the end portion102*a* of the second connection flow tube 102. In this manner, the first fluid chamber 14*f* is connected to the accumulator 53 before the second fluid chamber 14*g* is connected to the discharging fluid tube 56*b*.

Figure 6B:
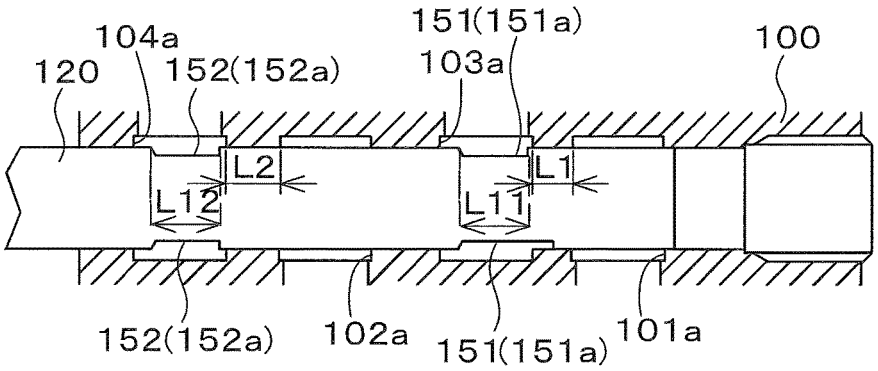
FIG. 6B is a cross section view illustrating the ride control valve according to the third embodiment, the cross section view explaining a relationship between the shortest distance L1 and the shortest distance L2.

FIG. 6B illustrates another modified example of the ride control valve 54. In the modified example of FIG. 6B, the shortest distance L1 between the end portion 101*a* and the end portion 103*a* is different from the shortest distance L2 between the end portion 102*a* and the end portion 104*a*. For example, the shortest distance L1 is longer than the shortest distance L2. The length L11 of the first groove 151*a* is substantially equal to the length L12 of the second groove 152*a*.

Also in the modified example shown in FIG. 6B, when the spool 120 is moved from the non-connection state, the first groove 151*a* is overlapped with the end portion 101*a* of the first connection flow tube 101 before the second groove 152*a* is overlapped with the end portion102*a* of the second connection flow tube 102. In this manner, the first fluid chamber 14*f* is connected to the accumulator 53 before the second fluid chamber 14*g* is connected to the discharging fluid tube 56*b*.

Figure 7A:
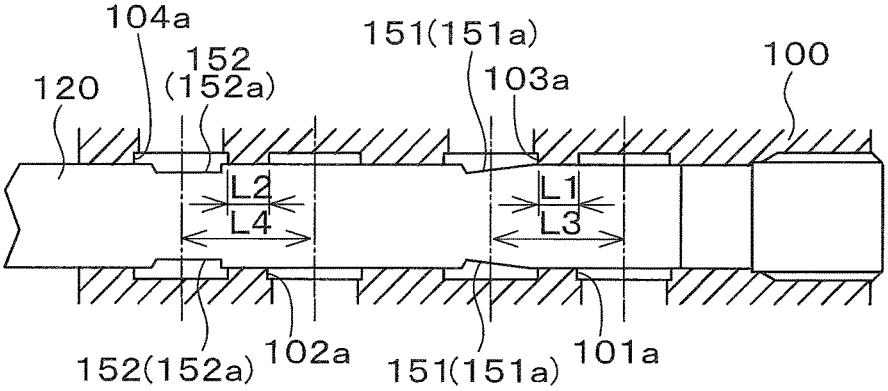
FIG. 7A is a cross section view illustrating the ride control valve according to the third embodiment, the cross section view explaining an opening area of the first groove and an opening area of the second groove.

FIG. 7A illustrates a modified example of the ride control valve 54. In the modified example of FIG. 7A, a first opening area of the communication between the first connection flow tube 101 and the third connection flow tube 103 is different from a second opening area of the communication between the second connection flow tube 102 and the fourth connection flow tube 104. The first opening area and the second opening area both are cross-sectional areas where the operation fluid passes through.

As shown in FIG. 7A, the first groove 151*a* has an outer diameter (a distance from the axis to the wall portion) gradually increasing from one end (a left end) toward the other end (a right end). On the other hand, the second groove 152*a* has an outer diameter being uniform from one end (the left end) toward the other end (the right end). Meanwhile, the shortest distance L1 is substantially equal to the shortest distance L2 (the shortest distance L3 is substantially equal to the shortest distance L4).

In this manner, the opening area of the communication between the first groove 151*a* and the second groove 152*a* is increasing as the spool 120 moves rightward. However, the first opening area of the first groove 151*a* is smaller than the second opening area of the second groove 152*a*. In addition, the opening area of the communication between the first groove 151*a* and the second groove 152*a* is decreasing as the spool 120 moves leftward. However, the first opening area of the first groove 151*a* is smaller than the second opening area of the second groove 152*a*.

That is, the spool 120 is capable of varying the first opening area depending on the first groove 151*a* and the second groove 152*a* in accordance with a stroking amount (a moving amount) of the spool 120. Shapes of the first groove 151*a* and the second groove 152*a* are not limited to the shapes shown in FIG. 7A. The shapes are not limited to specified shapes, but the opening area of the first groove 151*a* has to be different from the opening area of the second groove 152*a*.

For example, the opening areas of the first groove 151*a* and the second groove 152*a* may be varied by changing numbers of the first groove 151*a* and the second groove 152*a* each formed on the peripheral surface of the spool 120. For the changing of numbers of the first groove 151*a* and the second groove 152*a*, it is preferable for the first groove 151*a* and the second groove 152*a* to be arranged symmetrically about the axis of the spool 120.

Figure 7B:
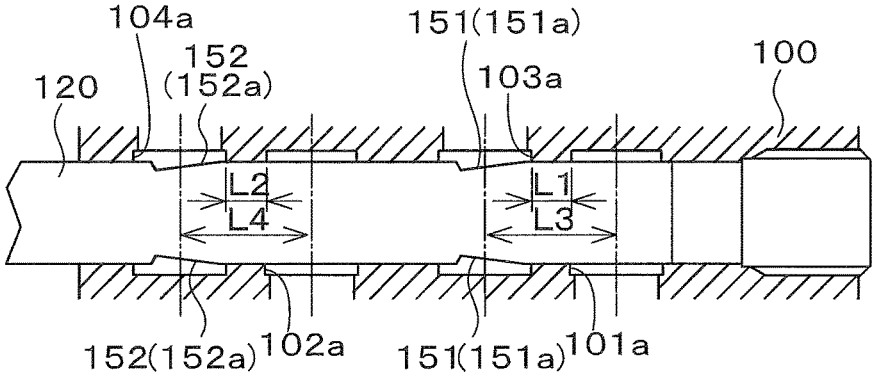
FIG. 7B is a cross section view illustrating the ride control valve according to the third embodiment, the cross section view explaining changing of the opening areas of the first groove and the second groove based on a stroking amount.

FIG. 7B illustrates a modified example of the ride control valve 54. In the modified example of FIG. 7B, the opening area of the first groove 151*a* is substantially equal to the opening area of the second groove 152*a* when the spool 120 is at a predetermined position. However, the spool 120 is capable of varying the first opening area and the second opening area in accordance with the stroking amount of the spool 120.

For example, each of the first groove 151*a* and the second groove 152*a* has an outer diameter gradually increasing from one end (a left end) toward the other end (a right end). That is, an inclining surface of the first groove 151*a* is substantially equivalent to an inclining surface of the second groove 152*a*. In this manner, the spool 120 is capable of varying the opening areas of the first groove 151*a* and the second groove 152*a* in accordance with the stroking amount of the spool 120.

The stroking amount of the spool 120 is changed depending on an operational condition (traveling or not, operating the actuator or not). For example, the stroking amount of the spool 120 is reduced in stopping the traveling of the work machine 1, and thereby the operation of the actuator may be prioritized. And, the stroking amount of the spool 120 is reduced in the traveling of the work machine 1, and thereby the anti-vibration operation may be prioritized.

In addition, in a case where the ride control valve 54 is constituted of a switch valve, the ride control valve 54 is switched with a small shock by gradually changing the stroking amount of the spool 120. In FIG. 7B, the shapes of the first groove 151*a* and the second groove 152*a* are not limited to specified shapes, but the first groove 151*a* and the second groove 152*a* have shapes changing the opening areas in accordance with the stroking amount of the spool 120.

(Fourth Embodiment)

Figure 8:
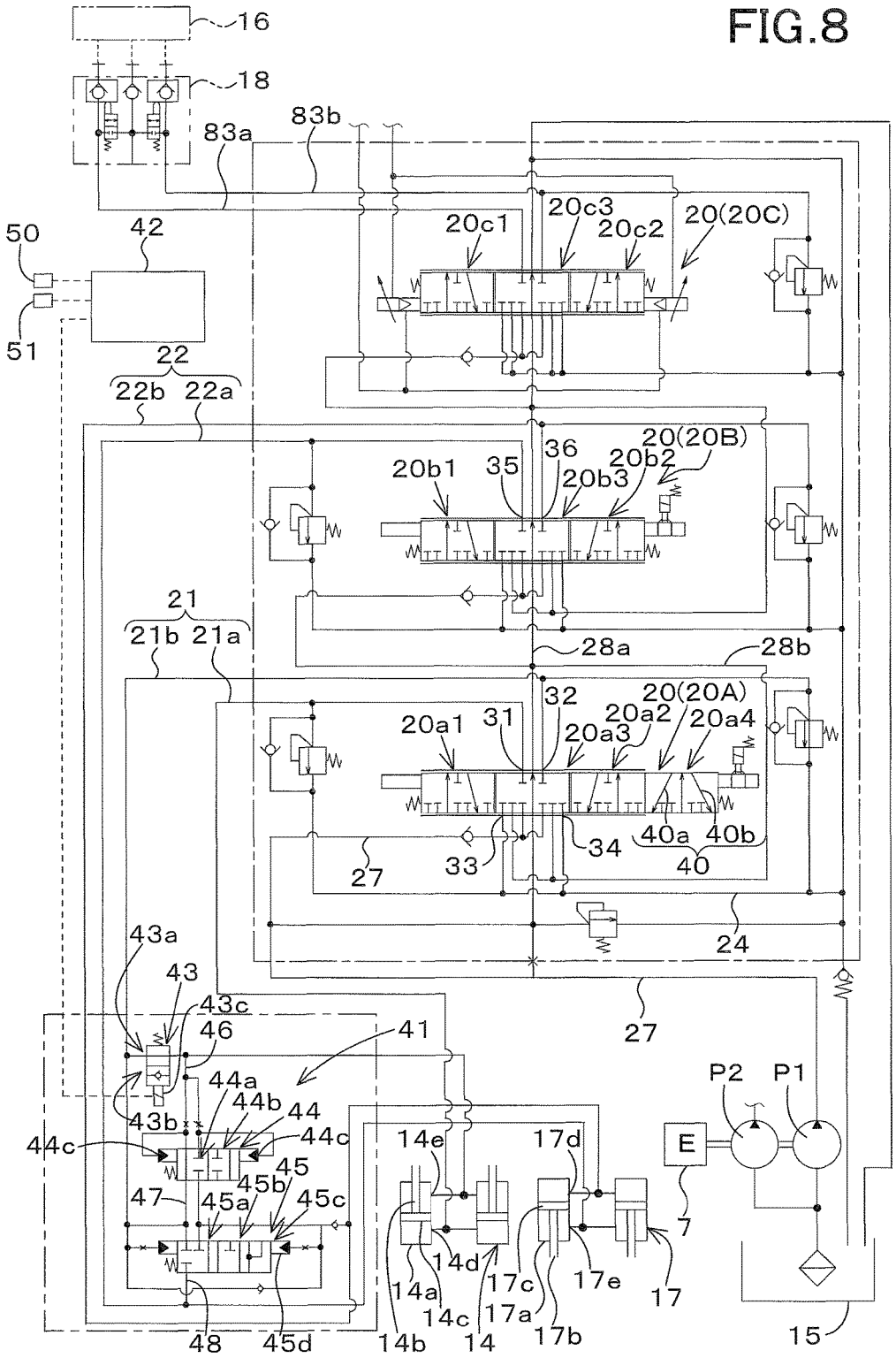
FIG. 8 is a view illustrating a hydraulic system (a hydraulic circuit) according to a fourth embodiment of the present invention.

FIG. 8 illustrates a hydraulic system according to a fourth embodiment of the present invention. Explanations of components of the hydraulic system (a hydraulic circuit) similar to the components of the embodiments described above will be omitted by being given reference numerals identical to the reference numerals of the embodiments described above.

As shown in FIG. 8, the first control valve 20A is a four-position switch valve of a direct-acting spool type. The first control valve 20A is capable of being switched to the neutral position 20*a*3, the first position 20*a*1 other than the neutral position 20*a*3, a second position 20*a*2 other than the neutral position 20*a*3 and the first position 20*a*1, and a third position 20*a*4. The first control valve 20A is switched to the neutral position 20*a*3, the first position 20*a*1, the second position 20*a*2, and the third position 20*a*4 by a spool, the spool being operated by an operation member.

In addition, the first control valve 20A includes a float part (a float device) 40 that is configured to operate the boom cylinder 14 in a floating operation. The float part 40 is disposed on the spool of the first control valve 20A. The float part 40 includes a communication tube (a communication path) 40*a* and a communication tube (a communication path) 40*b*. The communication tube 40*a* connected to the first port 31 and to the first discharge port 33 makes a communication between the first port 31 and the first discharge port 33. The communication tube 40*b* connected to the second port 32 and to the second discharge port 34 makes a communication between the second port 32 and the second discharge port 34. The first discharge port 33 and the second discharge port 34 are connected to the discharge fluid tube 24 that is connected to the operation fluid tank 15.

In this manner, when the first control valve 20A is switched to the third position 20*a*4, the first port 31 communicates with the first discharge port 33, and the second port 32 communicates with the second discharge port 34. An operation fluid in the cylinder body 14*a* of the boom cylinder 14 flows through the first fluid tube 21, the first port 31, the second port 32, the communication tube 40*a*, the communication tube 40*b*, the first discharge port 33, and the second discharge port 34 and then is discharged to the discharge fluid tube 24. In this manner, the boom cylinder 14 is operated in the floating operation.

The floating operation of the boom cylinder 14, that is, the switching of the first control valve 20A to the third position 20*a*4 can be provided by, for example, the first operation member 50 disposed around the operator seat 8. The first operation member 50 is a switch. When the switch 50 is turned on, the first control valve 20A is switched to the third position 20*a*4, and then the floating operation can start.

The second control valve 20B is connected to the first control valve 20A by the first supplying-discharging fluid tube 28*a* and the second supplying-discharging fluid tube 28*b*. When the first control valve 20A is switched to the neutral position 20*a*3 or to the third position 20*a*4, an operation fluid is supplied to the second control valve 20B through the first supplying-discharging fluid tube 28*a*. In addition, when the first control valve 20A is switched to the first position 20*a*1 or to the second position 20*a*2, an operation fluid is supplied to the second control valve 20B through the second supplying-discharging fluid tube 28*b*.

As shown in FIG. 8, the hydraulic system includes the level control part 41 and the control device 42. The level control part 41 is a level control valve for providing a leveling operation (other operations) to the second hydraulic actuator (the bucket cylinder) 17. The level control part 41 includes the operation part 43, the first control part 44, and the second control part 45. In the embodiment, the operation part 43 is referred to as a first switch part (a first switch).

The control device 42 issues a command of the leveling control (the leveling operation) to the level control part 41. The control device 42 outputs a command to the level control part 41, the commend being to stop the leveling operation at least in the floating operation. In particular, the switch 50 is connected to the control device 42, and thus a signal (the turning on and the turning off of the switch 50) is inputted to the control device 42, the signal indicating whether or not to provide the floating operation. In addition, the operation member such as the switch 51 is connected to the control device 42, and thus a signal (the turning on and the turning off of the switch 51) is inputted to the control device 42, the signal indicating whether or not to provide the leveling operation.

In a case where the switch 50 is turned off (the floating operation is not provided), the control device 42 magnetizes the solenoid 43*c* of the first switch part 43 when the turning-on of the switch 51 (the command to activate the leveling operation) is inputted to the control device 42. The first switch part 43 is switched to the second position 43*b* when the solenoid 43*c* of the first switch part 43 is magnetized.

In a case where the switch 50 is turned off (the floating operation is not provided), the control device 42 demagnetizes the solenoid 43*c* of the first switch part 43 when the turning-off of the switch 51 (the command to stop the leveling operation) is inputted to the control device 42. The first switch part 43 is switched to the first position 43*a* when the solenoid 43*c* of the first switch part 43 is demagnetized.

In a case where the switch 50 is turned on (the floating operation is provided), the control device 42 does not magnetize the solenoid 43*c* of the first switch part 43 (turns the first switch part 43 off) when the turning-on of the switch 51 (the command to activate the leveling operation) is inputted to the control device 42.

That is, when the floating operation and the leveling operation is set to be in operation by the switches 50 and 51, the control device 42 does not activate the leveling operation and stops the leveling operation (the control device 42 magnetizes the solenoid 43*c* of the first switch part 43). In other words, the control device 42 forbids execution of the leveling operation when the floating operation is set to be in operation and further the leveling operation is set to be in operation by the switches 50 and 51.

The control device 42 does not issue the command to activate the leveling operation to the leveling control part 41 when the switch 51 to activate the leveling operation is turned on from a state turned off during the floating operation.

In a case where the switch 51 to activate the leveling operation is turned on and thus the leveling operation is in operation, the control device 42 issues a command to the level control part 41 (the control device 42 magnetizes the solenoid 43*c* of the first switch part 43), the command being to forbid (stop) the leveling operation when the switch 50 to activate the floating operation is turned on from a state turned off.

As described above, the bucket 11 can be held horizontally in the upward movement of the boom 10 by the switch 51 turning the leveling operation on under a state where the switch 50 turns the floating operation off.

In addition, the control device 42 does not switch the first switch part 43 to the second position 43*b* even when the switch 50 turns the floating operation on and further the switch 51 turns the leveling operation on. In this manner, the returning fluid from the boom cylinder 14 is discharged to the operation fluid tank 15, and thus the floating operation can be appropriately provided.

(Fifth Embodiment)

Figure 9:
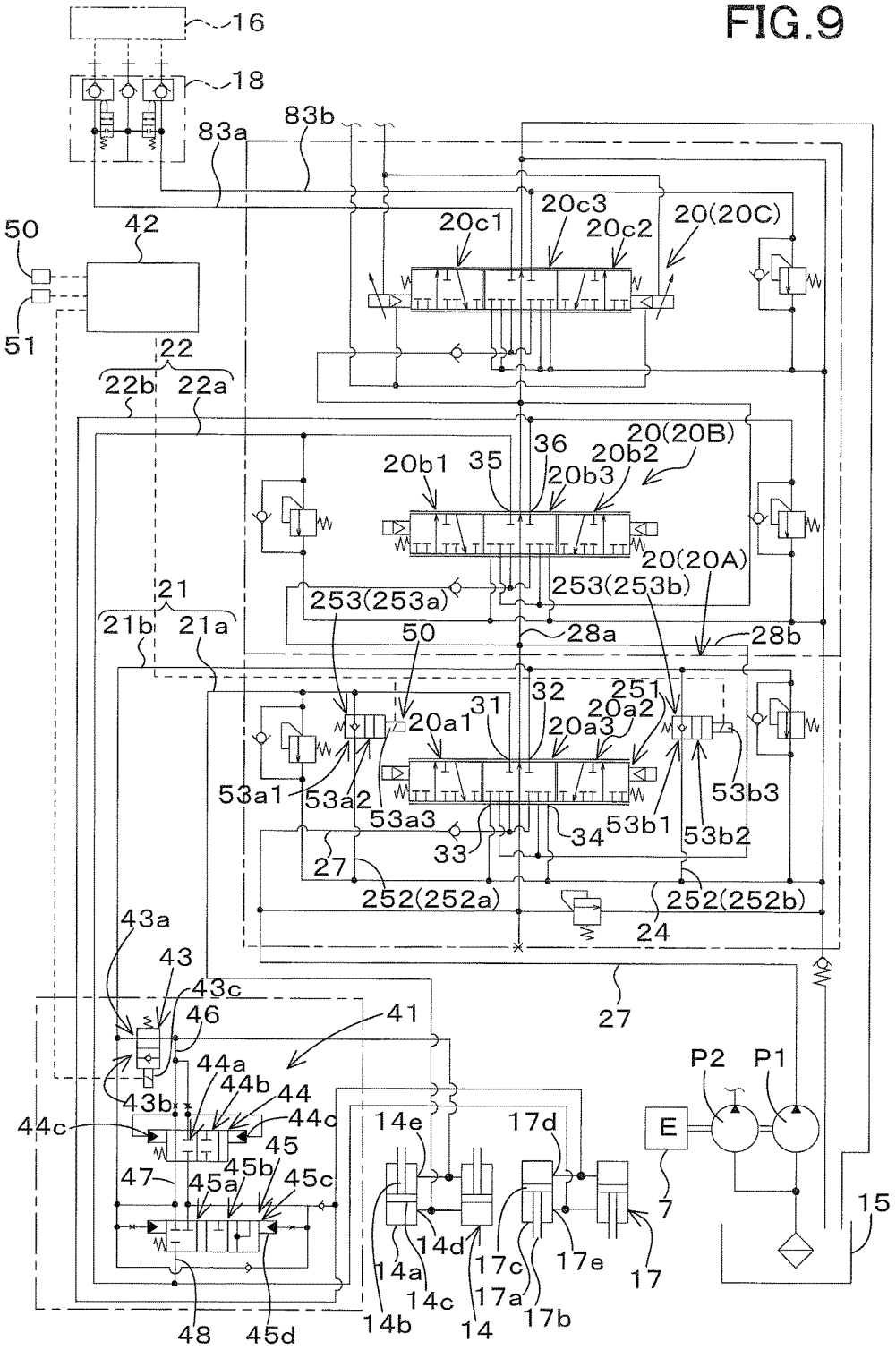
FIG. 9 is a view illustrating a hydraulic system (a hydraulic circuit) according to a fifth embodiment of the present invention.

FIG. 9 illustrates a hydraulic system according to a fifth embodiment of the present invention. The fifth embodiment describes a modified example of the hydraulic system according to the fourth embodiment. Explanations of components of the hydraulic system similar to the components of the embodiments described above will be omitted by being given reference numerals identical to the reference numerals of the embodiments described above.

As shown in FIG. 9, the first control valve 20A according to the fifth embodiment includes a float part (float device) 250 in addition to the spool. The first control valve 20A includes the float part 250 and a three-position switch valve (a switch valve) 251 of a direct-acting spool type using the pilot fluid. The switch valve 251 is configured to be switched to the first position 20*a*1, to the second position 20*a*2, and to the neutral position 20*a*3.

The switch valve 251 has a configuration similar to the switch valve of the first control valve 20A described above with the exception of the float part 40 described above, and thus the explanation of the switch valve 251 will be omitted by being given reference numerals identical to the reference numerals of the embodiments described above (the explanation of the first control valve 20A according to the fourth embodiment may be applied to the switch valve 251). The float part 259 includes a plurality of float flow tubes (float flow paths) 252 and a plurality of second switch parts (second switches) 253.

The plurality of float flow tubes 252 includes a first float flow tube (a first float flow path) 252*a* and a second float flow tube (a second float flow path) 252*b*. The first float flow tube 252*a* connects the first supply tube 21*a* to the discharge fluid tube 24. The second float low tube 252*b* connects the second supply tube 21*b* to the discharge fluid tube 24.

The plurality of second switch parts 253 includes a second switch part 253*a* and a second switch part 253*b*. The second switch part 253*a* is connected to an intermediate portion of the first float flow tube 252*a*. The second switch part 253*b* is connected to an intermediate portion of the second float flow tube 252*b*. The second switch part 253*a* is a two-position switch valve configured to be switched to a first position 53*a*1 and to a second position 53*a*2.

When the second switch part 253*a* is switched to the first position 53*a*1, the second switch part 253*a* blocks an operation fluid so as not to pass through the first float flow tube 252*a* and be discharged from the first supply tube 21*a* to the discharge fluid tube 24. When the second switch part 253*a* is switched to the second position 53*a*2, the second switch part 253*a* allows an operation fluid so as to pass through the first float flow tube 252*a* and be discharged from the first supply tube 21*a* to the discharge fluid tube 24. That is, the second switch part 253*a* is opened (released) at the second position 53*a*2.

The second switch part 253*b* is a two-position switch valve configured to be switched to a first position 53*b*1 and to a second position 53*b*2. When the second switch part 253*b* is switched to the first position 53*b*1, the second switch part 253*b* blocks an operation fluid so as not to pass through the second float flow tube 252*b* and be discharged from the second supply tube 21*b* to the discharge fluid tube 24. When the second switch part 253*b* is switched to the second position 53*b*2, the second switch part 253*b* allows an operation fluid so as to pass through the second float flow tube 252*b* and be discharged from the second supply tube 21*b* to the discharge fluid tube 24. That is, the second switch part 253*b* is opened (released) at the second position 53*b*2.

In this manner, when the second switch part 253*a* is switched to the second position 53*a*2 and further the second switch part 253*b* is switched to the second position 53*b*2, the operations fluids in the first supply tube 21*a* and the second supply tube 21*b* pass through the first float flow tube 252*a* and the second float flow tube 252*b* and then are discharged to the discharge fluid tube 24. Thus, the floating operation is turned on.

In addition, when the second switch part 253*a* is switched to the first position 53*a*1 and further the second switch part

253*b* is switched to the first position 53*b*1, the operations fluids in the first supply tube 21*a* and the second supply tube 21*b* pass through the first float flow tube 252*a* and the second float flow tube 252*b* and then are not discharged to the discharge fluid tube 24. Thus, the floating operation is turned off.

The control device 42 switches the second switch part 253 (53*a* and 53*b*). When the switch 50 is tuned on, the control device 42 magnetizes a solenoid 53*a*3 of the second switch part 253*a* and a solenoid 53*b*3 of the second switch part 253*b*. When the switch 50 is tuned off, the control device 42 demagnetizes the solenoid 53*a*3 of the second switch part 253*a* and the solenoid 53*b*3 of the second switch part 253*b*.

In this manner, the control device 42 demagnetizes the solenoid 43*c* of the first switch part 43 under the state where the solenoid 53*a*3 of the second switch part 253*a* and the solenoid 53*b*3 of the second switch part 253*b* are magnetized.

As described above, the control device 42 does not switch the first switch part 43 to the second position 43*b* even when the switch 50 to activate the floating operation is turned on and further the switch 51 to activate the leveling operation is turned on. In this manner, the returning fluid from the boom cylinder 14 can be discharged to the operation fluid tank 15, and thus the floating operation can be appropriately provided.

In the embodiments mentioned above, the plurality of float flow tubes 252 are connected by the plurality of second switch parts 253. However, the number of the second switch parts 253 may be one. For example, the plurality of float flow tubes 252 may be joined at intermediate portions of the float flow tubes 252, and the float flow tubes joined to each other may be connected by the second switch part 253.

According to the embodiments mentioned above, the ride control and other operations may be appropriately activated in the hydraulic system for the work machine, the hydraulic system employing the ride control. In addition, both of the floating operation and the leveling operation can be activated appropriately in the hydraulic system employing both of the operations.

In the above description, the embodiments of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

In the embodiments mentioned above, the operation fluid is discharged to the operation fluid tank. However, the operation fluid may be discharged to another component. That is, the fluid tube used for discharging the operation fluid may be connected to a component other than the operation fluid tank. For example, the fluid tube may be connected to a suction part of the hydraulic pump (a portion to suction the operation fluid), and may be connected to another portion.

In the embodiments mentioned above, the fluid tube 56*b* linked to the second port 54*e* serves as the discharge fluid tube. However, another accumulator other than the accumulator 53 may be connected to the fluid tube 56*b*.

Preferred embodiments of the invention are specified in the following paragraphs.

A hydraulic system for a work machine including a first hydraulic actuator having a first fluid chamber and a second fluid chamber, an accumulator, a first connection flow tube connected to a connection fluid tube connected to the accumulator, a second connection flow tube connected to a discharge fluid tube configured to discharge an operation fluid, a third connection flow tube connected to a third connection fluid tube connected to the first fluid chamber of the first hydraulic actuator, a fourth connection flow tube connected to a fourth connection fluid tube connected to the second fluid chamber of the first hydraulic actuator, and a spool configured to move to connect the first connection flow tube to the third connection flow tube and connect the second connection flow tube to the fourth connection flow tube, the spool having a first starting position to start connecting the first connection flow tube to the third connection flow tube and a second starting position other than the first staring position, the second starting position being to start connecting the second connection flow tube to the fourth connection flow tube.

The spool is held under a state connecting the first connection flow tube to the third connection flow tube and blocking the connection between the second connection flow tube and the fourth connection flow tube.

The first hydraulic actuator is a boom cylinder configured to move a boom upward and downward, the third connection flow tube is connected to a bottom side of the boom cylinder, and the fourth connection flow tube is connected to a rod side of the boom cylinder.

A hydraulic system for a work machine includes a first hydraulic actuator having a first fluid chamber and a second fluid chamber, an accumulator, a first connection flow tube connected to a connection fluid tube connected to the accumulator, a second connection flow tube connected to a discharge fluid tube configured to discharge an operation fluid, a third connection fluid tube connected to the first fluid chamber of the first hydraulic actuator, a third connection flow tube connected to the third connection fluid tube, a fourth connection fluid tube connected to the second fluid chamber of the first hydraulic actuator, a fourth connection flow tube connected to the fourth connection fluid tube, and a spool configured to move to connect the first connection flow tube to the third connection flow tube and connect the second connection flow tube to the fourth connection flow tube, the spool having a first opening area in the connection between the first connection flow tube and the third connection flow tube and a second opening area in the connection between the second connection flow tube and the fourth connection flow tube, the second opening area being different from the first opening area.

A hydraulic system for a work machine includes a first hydraulic actuator having a first fluid chamber and a second fluid chamber, an accumulator, a first connection flow tube connected to a connection fluid tube connected to the accumulator, a second connection flow tube connected to a discharge fluid tube configured to discharge an operation fluid, a third connection fluid tube connected to the first fluid chamber of the first hydraulic actuator, a third connection flow tube connected to the third connection fluid tube, a fourth connection fluid tube connected to the second fluid chamber of the first hydraulic actuator, a fourth connection flow tube connected to the fourth connection fluid tube, and a spool configured to move to connect the first connection flow tube to the third connection flow tube and connect the second connection flow tube to the fourth connection flow tube, the spool being configured to change a first opening area and/or a second opening area based on a movement of the spool, the first opening area being in the connection between the first connection flow tube and the third connection flow tube, the second opening area being in the connection between the second connection flow tube and the fourth connection flow tube.

A hydraulic system for a work machine includes a first hydraulic actuator having a first fluid chamber and a second fluid chamber, an accumulator, a first connection flow tube connected to a connection fluid tube connected to the accumulator, a second connection flow tube connected to a discharge fluid tube configured to discharge an operation fluid, a third connection fluid tube connected to the first fluid chamber of the first hydraulic actuator, a third connection flow tube connected to the third connection fluid tube, a fourth connection fluid tube connected to the second fluid chamber of the first hydraulic actuator, a fourth connection flow tube connected to the fourth connection fluid tube, and a spool configured to move to a first position and a second position, the spool including a first connector constituted of a groove formed on a circumference surface of the spool, the first connector being configured to block a connection between the first connection flow tube and the third connection flow tube at the first position and connect the first connection flow tube to the third connection flow tube at the second position and a second connector constituted of a groove formed on the circumference surface of the spool and shorter than the first groove, the second connector being configured to block a connection between the second connection flow tube and the fourth connection flow tube at the first position and connect the second connection flow tube to the fourth connection flow tube at the second position.

A hydraulic system for a work machine includes a first hydraulic actuator, a second hydraulic actuator other than the first hydraulic actuator, a first control valve to control the first hydraulic actuator, including a float device to control a floating operation for the first hydraulic actuator, a second control valve to control the second hydraulic actuator, a first fluid tube connected to the first hydraulic actuator, a second fluid tube connected to the second hydraulic actuator, a level control valve apparatus connected to the first fluid tube and the second fluid tube, the level control valve apparatus being configured to control a leveling operation for the second hydraulic actuator, and a controller to stop the leveling operation when the accumulator apparatus is in operation.

The level control valve apparatus includes a first switch to switch the leveling operation on and off and the controller turns the first switch off when the floating operation is in operation.

The first fluid tube includes a first supply tube connected to a first port of the first hydraulic actuator and a second supply tube connected to a second port of the first hydraulic actuator, and the first switch is connected to the second supply tube.

The float device includes a second switch configured to turn the float device on and off and the controller turns the first switch off when the second switch is turned on.

The first hydraulic actuator is a boom cylinder, and the second hydraulic cylinder is a bucket cylinder.

The first fluid tube connects the first control valve to the first hydraulic actuator, and the second fluid tube connects the second control valve to the second hydraulic actuator.

A work machine includes the hydraulic system for the work machine described above.

What is claimed is:

1. A hydraulic system for a work machine, comprising:

a first hydraulic actuator;

a second hydraulic actuator other than the first hydraulic actuator;

a first control valve to control the first hydraulic actuator;

a second control valve to control the second hydraulic actuator;

a first fluid tube connecting the first hydraulic actuator to the first control valve;

a second fluid tube connecting the second hydraulic actuator to the second control valve;

a level control valve apparatus connected to the first fluid tube and the second fluid tube, the level control valve apparatus being configured to control a leveling operation for the second hydraulic actuator;

an accumulator apparatus connected to the first hydraulic actuator, the accumulator apparatus communicating with the first fluid tube between the level control valve apparatus and the first control valve; and circuitry configured to control the level control valve apparatus to stop the leveling operation when the accumulator apparatus is in operation.

2. The hydraulic system for the work machine, according to claim 1, wherein the level control valve apparatus includes an operation device configured to switch an operational state between a first state to stop the leveling operation and a second state to activate the leveling operation, and the circuitry switches the operation device to the first state to stop the leveling operation when the accumulator apparatus is in operation.

3. The hydraulic system for the wok machine, according to claim 2, wherein the first hydraulic actuator is a boom cylinder, the second hydraulic actuator is a bucket cylinder, and the circuitry switches the operation device to the second state to activate the leveling operation when the boom cylinder is stretched.

4. The hydraulic system for the work machine according to claim 1, wherein the level control valve apparatus includes a switch valve configured to be switched to a first position such that, in the first fluid tube, an operation fluid returns from the first hydraulic actuator to the first control valve and flows from the first control valve to the first hydraulic actuator, a second position such that the flow of the operation fluid returning in the first fluid tube from the first hydraulic actuator to the first control valve is blocked.

5. The hydraulic system for the work machine, according to claim 4, wherein the level control valve apparatus includes a flow tube connecting the first fluid tube to the second fluid tube, the operation fluid being supplied to the second hydraulic actuator through the flow tube when the switch valve is at the second position, the operation fluid returning from the first hydraulic actuator to the first control valve.

6. The hydraulic system for the work machine, according to claim 1, wherein the first fluid tube includes:

a first supply tube connected to a bottom side of a first hydraulic cylinder constituting the first hydraulic actuator; and a second supply tube connected to a rod side of the first hydraulic cylinder, and the second fluid tube includes:

a third supply tube connected to a rod side of a second hydraulic cylinder constituting the second hydraulic actuator; and a fourth supply tube connected to a bottom side of the second hydraulic cylinder.

7. A hydraulic system for a work machine, comprising:

a first hydraulic actuator;

a second hydraulic actuator other than the first hydraulic actuator;

a first control valve to control the first hydraulic actuator;

a second control valve to control the second hydraulic actuator;

a first fluid tube connecting the first hydraulic actuator to the first control valve;

a second fluid tube connecting the second hydraulic actuator to the second control valve;

a level control valve apparatus connected to the first fluid tube and the second fluid tube, the level control valve apparatus being configured to control a leveling operation for the second hydraulic actuator;

an accumulator apparatus connected to the first hydraulic actuator; and a third fluid tube having a first tube end connected to the first hydraulic actuator and a second tube end which is opposite to the first tube end and which is connected to the first fluid tube between the level control valve apparatus and the first control valve.

8. The hydraulic system for the work machine, according to claim 7, comprising a discharge fluid tube connected to the accumulator apparatus, the discharge fluid tube being configured to discharge an operation fluid supplied from the accumulator apparatus, wherein the accumulator apparatus includes:

an accumulator; and a ride control valve configured to connect the third fluid tube, the first hydraulic actuator, the accumulator, and the discharge fluid tube to each other, and the ride control valve is configured to be switched to a stopping position to block a connection between the first hydraulic actuator and the accumulator and to block a connection between the third hydraulic tube and the discharge fluid tube and an activating position to connect the first hydraulic actuator to the accumulator and to connect the third hydraulic tube and the discharge fluid tube.

9. The hydraulic system for the work machine, according to claim 7, wherein the level control valve apparatus includes a switch valve configured to be switched to a first position such that, in the first fluid tube, an operation fluid returns from the first hydraulic actuator to the first control valve and flows from the first control valve to the first hydraulic actuator, and a second position such that the flow of the operation fluid returning in the first fluid tube from the first hydraulic actuator to the first control valve is blocked.

10. The hydraulic system for the work machine, according to claim 9, wherein the level control valve apparatus includes a flow tube connecting the first fluid tube to the second fluid tube, the operation fluid being supplied to the second hydraulic actuator through the flow tube when the switch valve is at the second position, the operation fluid returning from the first hydraulic actuator to the first control valve.

11. The hydraulic system for the work machine, according to claim 7, wherein the first fluid tube includes:

a first supply tube connected to a bottom side of a first hydraulic cylinder constituting the first hydraulic actuator; and a second supply tube connected to a rod side of the first hydraulic cylinder, and the second fluid tube includes:

a third supply tube connected to a rod side of a second hydraulic cylinder constituting the second hydraulic actuator; and a fourth supply tube connected to a bottom side of the second hydraulic cylinder.

12. A hydraulic system for a work machine, comprising:

a first hydraulic actuator;

a second hydraulic actuator other than the first hydraulic actuator;

a first control valve to control the first hydraulic actuator;

a second control valve to control the second hydraulic actuator;

a first fluid tube connecting the first hydraulic actuator to the first control valve;

a second fluid tube connecting the second hydraulic actuator to the second control valve;

a level control valve apparatus connected to the first fluid tube and the second fluid tube, the level control valve apparatus being configured to control a leveling operation for the second hydraulic actuator; and an accumulator apparatus connected to the first hydraulic actuator, the accumulator apparatus communicating with the first fluid tube between the level control valve apparatus and the first control valve, the accumulator apparatus being configured to provide an anti-vibration operation to suppress fluctuation of a pressure of the first hydraulic actuator, the accumulator apparatus being configured to switch an operational state among a stopping state to stop the anti-vibration operation, a first operational state to activate both of the leveling operation and the anti-vibration operation, and a second operational state to activate the anti-vibration operation.

13. The hydraulic system for the work machine, according to claim 12, wherein the level control valve apparatus includes a switch valve configured to be switched to a first position such that, in the first fluid tube, an operation fluid returns from the first hydraulic actuator to the first control valve and flows from the first control valve to the first hydraulic actuator, and a second position such that the flow of the operation fluid returning in the first fluid tube from the first hydraulic actuator to the first control valve is blocked.

14. The hydraulic system for the work machine, according to claim 13, wherein the level control valve apparatus includes a flow tube connecting the first fluid tube to the second fluid tube, the operation fluid being supplied to the second hydraulic actuator through the flow tube when the switch valve is at the second position, the operation fluid returning from the first hydraulic actuator to the first control valve.

15. The hydraulic system for the work machine, according to claim 12, wherein the first fluid tube includes:

a first supply tube connected to a bottom side of a first hydraulic cylinder constituting the first hydraulic actuator; and a second supply tube connected to a rod side of the first hydraulic cylinder, and the second fluid tube includes:

a third supply tube connected to a rod side of a second hydraulic cylinder constituting the second hydraulic actuator; and a fourth supply tube connected to a bottom side of the second hydraulic cylinder.

16. A hydraulic system for a work machine, comprising:

a first hydraulic actuator having:

a first fluid chamber; and a second fluid chamber;

a second hydraulic actuator other than the first hydraulic actuator;

a first control valve to control the first hydraulic actuator;

a second control valve to control the second hydraulic actuator;

a first fluid tube connecting the first hydraulic actuator to the first control valve;

a second fluid tube connecting the second hydraulic actuator to the second control valve;

a level control valve apparatus connected to the first fluid tube and the second fluid tube, the level control valve apparatus being configured to control a leveling operation for the second hydraulic actuator;

an accumulator apparatus connected to the first hydraulic actuator and configured to provide an anti-vibration operation to suppress fluctuation of a pressure of the first hydraulic actuator; and a discharge fluid tube connected to the accumulator apparatus, the discharge fluid tube being configured to discharge an operation fluid supplied from the accumulator apparatus, wherein the accumulator apparatus includes:

an accumulator; and a ride control valve configured to be switched to:

a stopping position to block a connection between the accumulator and the first fluid chamber of the first hydraulic actuator and to block a connection between the discharge fluid tube and the second fluid chamber of the first hydraulic actuator;

a first activating position to connect the first fluid chamber to the accumulator and to block the connection between the second fluid chamber and the discharge fluid tube, and thus to activate both of the leveling operation and the anti-vibration operation; and a second activating position to connect the first fluid chamber to the accumulator and to connect the second fluid chamber to the discharge fluid tube, and thus to activate the anti-vibration operation.

17. The hydraulic system for the work machine, according to claim 16, wherein the level control valve apparatus includes a switch valve configured to be switched to a first position such that, in the first fluid tube, an operation fluid returns from the first hydraulic actuator to the first control valve and flows from the first control valve to the first hydraulic actuator, and a second position such that the flow of the operation fluid returning in the first fluid tube from the first hydraulic actuator to the first control valve is blocked.

18. The hydraulic system for the work machine, according to claim 17, wherein the level control valve apparatus includes a flow tube connecting the first fluid tube to the second fluid tube, the operation fluid being supplied to the second hydraulic actuator through the flow tube when the switch valve is at the second position, the operation fluid returning from the first hydraulic actuator to the first control valve.

19. The hydraulic system for the work machine, according to claim 16, wherein the first fluid tube includes:

a first supply tube connected to a bottom side of a first hydraulic cylinder constituting the first hydraulic actuator; and a second supply tube connected to a rod side of the first hydraulic cylinder, and the second fluid tube includes:

a third supply tube connected to a rod side of a second hydraulic cylinder constituting the second hydraulic actuator; and a fourth supply tube connected to a bottom side of the second hydraulic cylinder.

* * * * *